US009828723B2

(12) United States Patent
Cain

(10) Patent No.: US 9,828,723 B2
(45) Date of Patent: Nov. 28, 2017

(54) TEXTILE ELEMENT

(71) Applicant: Stretchline Intellectual Properties Limited, Tortola (VG)

(72) Inventor: Miles Stephen Cain, Derbyshire (GB)

(73) Assignee: Stretchline Intellectual Properties Limited, Tortola (VG)

( * ) Notice: Subject to any disclaimer, the term of this patent is extended or adjusted under 35 U.S.C. 154(b) by 266 days.

(21) Appl. No.: 14/396,434

(22) PCT Filed: Apr. 22, 2013

(86) PCT No.: PCT/GB2013/051017

§ 371 (c)(1),
(2) Date: Oct. 23, 2014

(87) PCT Pub. No.: WO2013/160665

PCT Pub. Date: Oct. 31, 2013

(65) Prior Publication Data

US 2015/0093537 A1 Apr. 2, 2015

(30) Foreign Application Priority Data

Apr. 23, 2012 (GB) ..... 1207067.8
Aug. 9, 2012 (GB) ..... 1214221.2
(Continued)

(51) Int. Cl.
*D06N 3/00* (2006.01)
*A41C 1/12* (2006.01)
(Continued)

(52) U.S. Cl.
CPC ..... *D06N 3/0077* (2013.01); *A41C 1/12* (2013.01); *A41C 1/14* (2013.01); *A41C 3/12* (2013.01);
(Continued)

(58) Field of Classification Search
CPC .... D06N 3/004; D06N 3/0077; D06N 3/0081; D06N 3/125; D06N 3/123; D06N 3/0088;
(Continued)

(56) References Cited

U.S. PATENT DOCUMENTS 4,605,578 A 8/1986 Emrich et al.
4,701,964 A 10/1987 Bell et al.
(Continued)

FOREIGN PATENT DOCUMENTS

DE 29 45 939 A1 9/1980
DE 31 23 436 A1 12/1982
(Continued)

OTHER PUBLICATIONS

International Search Report issued in International Application No. PCT/GB2013/051017 dated Oct. 9, 2013.
(Continued)

*Primary Examiner* — Cheryl Juska
(74) *Attorney, Agent, or Firm* — RatnerPrestia

(57) ABSTRACT

A method of forming a textile element (10) for use as a structural support component in a garment is provided. The method includes providing a fabric strip (12) having a plush surface (16). A molten thermoplastic coating (14) is applied to the plush surface (16) of the fabric strip (12) so that the molten thermoplastic coating (14) penetrates the plush surface (16). The molten thermoplastic coating (14) is allowed to cool or cure and solidify so as to embed at least surface yarns of the plush surface (16) in the thermoplastic coating (14) and thereby form a composite structure at a juncture (J) between the thermoplastic coating (14) and the plush surface (16).

14 Claims, 13 Drawing Sheets

(30) Foreign Application Priority Data

Oct. 11, 2012 (GB) ..... 1218252.3
Apr. 9, 2013 (GB) ..... 1306431.6

(51) Int. Cl.
*A41C 1/14* (2006.01)
*A41C 3/12* (2006.01)
*A41D 1/22* (2006.01)
*D06N 3/12* (2006.01)

(52) U.S. Cl.
CPC ..... *A41C 3/128* (2013.01); *A41D 1/22* (2013.01); *D06N 3/004* (2013.01); *D06N 3/0088* (2013.01); *D06N 3/123* (2013.01); *D06N 3/125* (2013.01); *Y10T 428/23979* (2015.04); *Y10T 428/23986* (2015.04)

(58) Field of Classification Search
CPC ..... A41C 3/0007; A41C 3/12; A41C 1/12; A41D 1/22; Y10T 428/2419; Y10T 428/23914
USPC ..... 428/86, 97, 121; 427/177, 398.1
See application file for complete search history.

(56) References Cited

U.S. PATENT DOCUMENTS 5,167,891 A 12/1992 Dijkman, Sr. et al.
5,447,462 A 9/1995 Smith et al.
2002/0155786 A1 10/2002 Querquant
2003/0019373 A1 1/2003 Jordan
2003/0092355 A1 5/2003 Rabinowicz et al.
2006/0183852 A1 8/2006 Liu et al.
2007/0251636 A1* 11/2007 Herbert ..... A41D 27/245 156/217
2008/0073811 A1 3/2008 Wan
2008/0196136 A1 8/2008 Fellouhe et al.

FOREIGN PATENT DOCUMENTS

DE 39 29 930 C1 4/1990
EP 1 388 299 A2 2/2004
EP 2 153 739 A1 2/2010
GB 1 260 834 1/1972
VG 2501475 A * 10/2013 ..... A41C 1/14
VG 2501986 A * 11/2013 ..... A41C 1/14
WO 2004/002248 A2 1/2004
WO 2004/049839 A1 6/2004
WO 2007/089848 A2 8/2007
WO 2008/135750 A2 11/2008

OTHER PUBLICATIONS

Search Report issued in Great Britain Patent Application No. GB1306431.6 dated Sep. 10, 2013.
Search Report issued in Great Britain Patent Application No. GB1214221.2 dated Oct. 30, 2012.
Search Report issued in Great Britain Patent Application No. GB1207067.8 dated Jul. 20, 2012.

* cited by examiner

TEXTILE ELEMENT

BACKGROUND

The invention relates to a method of forming a textile element for use as a structural support component in a garment. The invention also relates to a textile element for use as a structural support component in a garment.

BRIEF DESCRIPTION OF THE DRAWINGS

Embodiments of the invention will now be described, by way of non-limiting examples, with reference to the accompanying drawings in which.

Figures 1A, 1B:
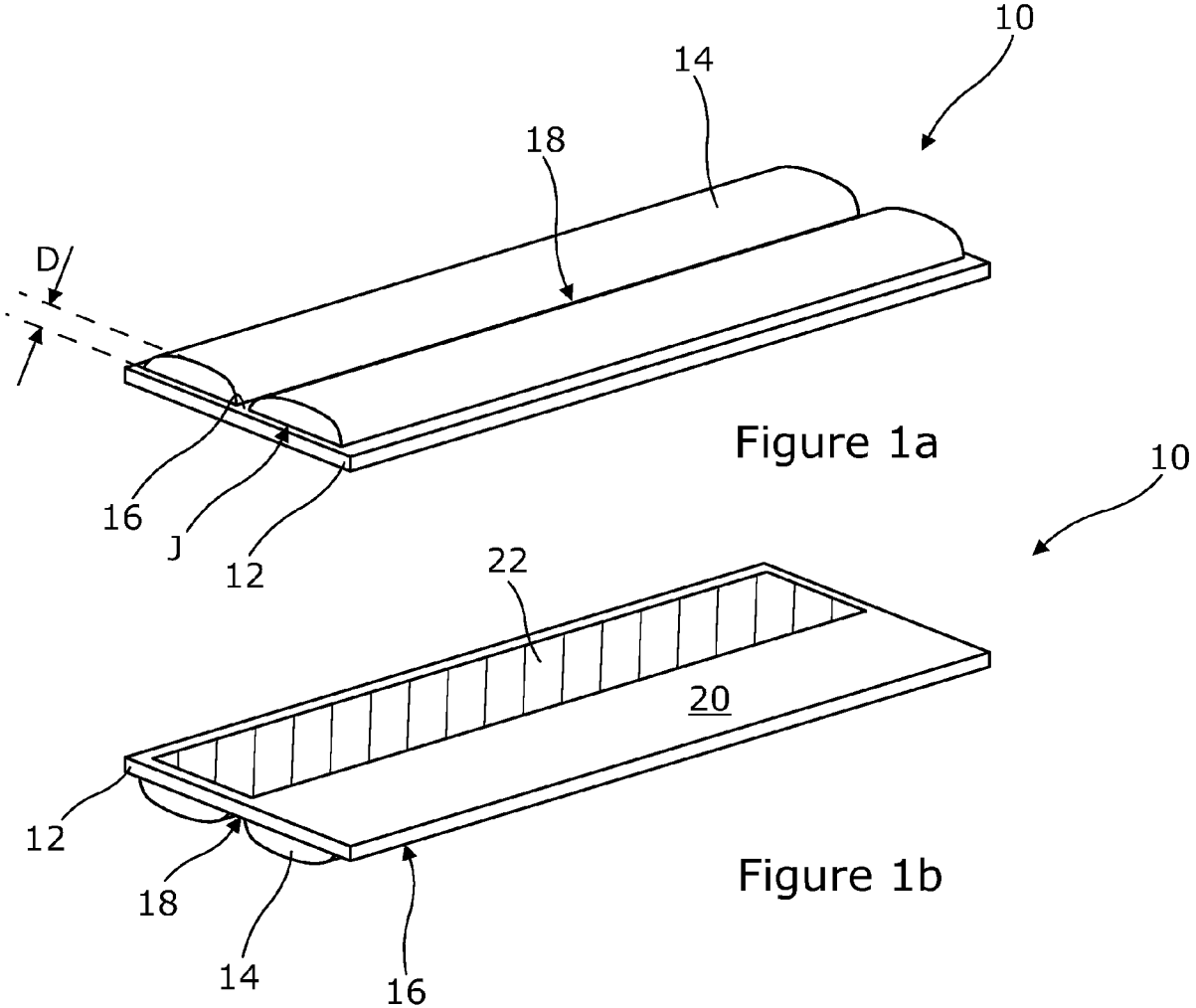
FIGS. 1*a* and 1*b* show opposites sides of a textile element according to a first embodiment of the invention.

According to an aspect of the invention there is provided a method of forming a textile element for use as a structural support component in a garment, the method comprising the steps of:

(i) providing a fabric strip having a plush surface;

(ii) applying a thermoplastic coating to the plush surface of the fabric strip so that the thermoplastic coating penetrates the plush surface; and (iii) allowing the thermoplastic coating to cool and rigidify so as to embed at least surface yarns of the plush surface in the thermoplastic coating and thereby form a composite structure at the juncture between the thermoplastic coating and the plush surface.

References to a plush surface herein are intended to refer to a fabric surface having a long, soft nap or raised pile.

The provision of a plush surface allows a molten thermoplastic material to absorb and penetrate into the fabric strip and encase at least surface yarns of the plush surface. This means that, once the thermoplastic coating is allowed to cool and rigidify, the surface yarns of the plush surface become embedded in the thermoplastic coating and form a composite structure at the juncture between the thermoplastic coating and the plush surface.

Penetration of the thermoplastic coating into the plush surface and the formation of a composite structure in which yarns are embedded in the thermoplastic coating greatly increases the strength and flexibility of the resultant textile element over and above a textile element formed from a thermoplastic material applied to a non-plush surface of a textile carrier. This is because a molten thermoplastic material cannot penetrate into a non-plush surface of a textile carrier and merely tacks itself to the non-plush surface. Accordingly the strength and flexibility of such a textile element is determined solely by the strength and flexibility of the thermoplastic material. Consequently, whilst use of the thermoplastic material will likely result in a relatively hard textile element, the textile element will be prone to breakage as a result of the brittleness of the thermoplastic material.

In contrast, the formation of a composite structure in which yarns are embedded in the thermoplastic material reduces the brittleness of the resultant textile element and results in a more flexible structure that is less prone to breakages.

It will be appreciated that the flexibility of the resultant textile element is determined by the extent to which the thermoplastic coating penetrates the plush surface. In particularly preferred embodiments, the fabric strip is a woven structure and the thermoplastic coating is applied to the plush surface so that the thermoplastic coating penetrates the plush surface so as to embed the warp yarns of the plush surface once the thermoplastic coating is allowed to cool and rigidify.

Such a degree of penetration of the thermoplastic coating into the plush surface of the fabric strip could result in a textile element in which the thermoplastic coating is exposed on the opposite side of the fabric strip. Consequently, in such embodiments, the fabric strip preferably includes a more densely woven backing to the plush surface so as to prevent penetration of the thermoplastic coating through the entire depth of the fabric strip.

The increased flexibility of the resultant textile element means that the textile element will return to its original shape upon flexing, unlike a conventional under-wire for a brassiere, for example, which is relatively inflexible and likely to remain in a bent configuration following bending or flexing. The use of a thermoplastic coating encasing at least the surface yarns of a plush surface of the fabric strip thus results in the creation of a structural support component that exhibits strength comparable to that of a conventional under-wire but which is more flexible and thus provides greater wearer comfort.

In a particularly preferred embodiment of the invention the thermoplastic coating penetrates the plush surface so as to produce a substantially elastic textile element once the thermoplastic coating is allowed to cool and rigidify. This is to say, the textile element will flex or bend upon application of a force tending to cause flexure or bending. It will then return automatically to its original shape once the force causing flexure or bending is removed.

In preferred embodiments of the invention, the fluidity of the thermoplastic material is increased prior to the step of applying the thermoplastic coating to the plush surface. This helps to increase the penetration of the thermoplastic coating into the plush surface. It also however increases the risk of leakage of thermoplastic material due to the fluidic nature of the thermoplastic material.

The use of a fabric strip having a plush surface however helps to prevent leakage of molten thermoplastic material during application of the thermoplastic coating—the plush surface restraining flow of the molten thermoplastic material. This is because the molten thermoplastic material penetrates into the plush surface and is therefore less likely to leak from the plush surface, which would otherwise likely be the case if the fabric strip omitted the plush surface.

The flow of molten thermoplastic material from the plush surface during and after application of the thermoplastic coating may be further prevented through the inclusion of a pair of ribs protruding from the fabric strip, on opposite sides of the plush surface. In such embodiments the thermoplastic coating is of course applied between the ribs.

So as to enhance the comfort of a wearer wearing a garment incorporating the resultant textile element, the fabric strip may be folded about the thermoplastic coating so as to sandwich the thermoplastic coating between the plush surface and an opposing surface of the fabric strip before allowing the thermoplastic coating to cool and rigidify. This improves the aesthetic appearance of the resultant textile element in that the folding step encases the thermoplastic coating within the fabric strip.

The step of folding the fabric strip preferably occurs after the thermoplastic coating has been allowed to cool to form a soft and tacky surface but before the thermoplastic coating has been allowed to cool and rigidify. It will be appreciated that allowing the thermoplastic coating to cool prior to folding the fabric strip about the thermoplastic coating reduces the risk of the thermoplastic material leaking. It also acts to increase the adhesive properties of the thermoplastic coating so that it may adhere to the opposing surface of the fabric strip.

In such embodiments the fabric strip may further include a pair of ribs protruding from the opposing surface of the fabric strip and the step of folding the fabric strip about the thermoplastic coating involves aligning the ribs protruding from the opposite surface in face to face contact with the ribs protruding from the fabric strip on opposite sides of the plush surface.

Such an arrangement further restrains the flow of molten thermoplastic material by forming an envelope to receive the thermoplastic coating.

The use of ribs to restrain the flow of molten thermoplastic material ensures the creation of textile-only regions on opposite sides of the plush surface, the textile-only regions being free from any thermoplastic coating. This is particularly important in circumstances where the resultant textile element is intended to be sewn onto a garment or otherwise to another textile piece. The absence of any thermoplastic coating facilitates penetration of the textile-only regions with a needle during the sewing process and reduces the risk of injury that might otherwise occur as a result of a snapping needle if a sewing machine needle was to impact thermoplastic material.

The creation of textile-only regions on opposite sides of the plush surface may be created in other embodiments through the incorporation of Grilon™ K-85 yarns in regions on opposites sides of the plush surface. The inclusion of Grilon™ K-85 yarns in such regions of the fabric strip renders those regions substantially impenetrable to molten thermoplastic material.

The thickness of the thermoplastic coating may be increased in embodiments of the invention through the inclusion of a plush surface between the ribs protruding from the opposing surface. In such embodiments the step of applying the thermoplastic coating may including applying the thermoplastic coating to the plush surface between the ribs protruding from the opposing surface so that the coating penetrates the plush surface. This effectively results in a double-layer of thermoplastic coating once the fabric strip is folded so as to align the ribs in face to face contact so as to form an envelope about the coating.

In each of the embodiments referred to above, the strength of the bond created between the thermoplastic coating and the plush surface to which it is applied, once the thermoplastic coating is allowed to cool and rigidify, may be increased by pre-heating the plush surface prior to the step of applying the thermoplastic coating thereto. In particularly preferred embodiments, the plush surface is pre-heated and the fluidity of the thermoplastic material is greatly increased, this combination of steps having been found to greatly increase the extent to which the thermoplastic material penetrates into the plush surface when it is applied and the strength of the composite that is created once the thermoplastic coating is allowed to cool and rigidify, encasing at least the surface yarns of the plush surface.

The plush surface may be pre-treated in other embodiments, so as to render the plush surface more receptive to the thermoplastic coating, by pre-treating the plush surface with plasma. This step may be performed immediately prior to the step of applying the thermoplastic coating.

In embodiments of the invention the method may further include the step of applying an adhesive coating to an opposite surface of the fabric strip to the plush surface and the thermoplastic coating.

In such embodiments, the adhesive coating may be applied to extend width wise across the opposite surface or may be applied to extend across half the width of the opposite surface. Applying the adhesive coating so as to extend across half the width of the opposite surface might be particularly advantageous in embodiments where, for example, it is intended to fold the resultant textile element at a later stage during attachment of the textile element to a garment.

It will be appreciated that the adhesive coating may be applied to the opposite surface at any stage during the method of forming a textile element. It is however preferable that the adhesive coating is applied after cooling and rigidifying of the thermoplastic coating, particularly if a hot-melt adhesive is used to form the adhesive coating.

The adhesive coating may be any adhesive suitable for adhering two layers of fabric together and may, for example, include a hot-melt polyurethane adhesive or a hot-melt polyamide adhesive or a silicone adhesive. Any such adhesive may be applied in the form of a powder coating or applied by means of extrusion on the fabric strip.

The comfort of the resultant textile element, in use, may be further improved in embodiments of the invention by flocking the fabric strip on an opposite surface to the plush surface and the thermoplastic coating.

In such embodiments the opposite surface may be flocked width wise across the fabric strip. Such an arrangement allows the resultant textile element to be secured to a garment with the thermoplastic coating in face to face contact with the garment fabric, thus presenting the opposite, flocking surface to a wearer's skin when the garment is worn.

In other such embodiments where, for example, it is intended to fold the resultant textile element at a later stage during attachment of the textile element to a garment, such that only half of the opposite surface will be presented to a wearer's skin when the garment is worn, the opposite surface may be flocked across half the width of the fabric strip only.

It will be appreciated that both the adhesive coating and the flocking may extend width wise across the fabric strip in a manner that creates a zero or partial or full overlap between the adhesive coating and the flocking.

The amount of support and rigidity provided by the resultant textile element is dependent on the amount of thermoplastic coating applied to the plush surface of the fabric strip. The shape of the resultant textile element is also determined by the amount and manner in which the thermoplastic material is applied to the plush surface.

In embodiments of the invention, the thermoplastic coating may be applied so as to form a bead extending along the plush surface following cooling and rigidifying of the thermoplastic coating. Such an arrangement facilitates use of the resultant textile element as a boning replacement in corsetry or as an under-wire replacement in a brassiere. It also allows the resultant textile element to be sewn into position, the creation of a bead on the plush surface inevitably leading to the creation of textile-only regions on opposite sides of the bead of thermoplastic coating.

In other embodiments, particularly those in which the resultant textile element is intended to be adhered to a garment in order to form a structural support component as opposed to being sewn into position, the thermoplastic coating may be applied width wise across the plush surface of the fabric strip so as to extend across the entire width of the plush surface. In such embodiments, the depth of the thermoplastic coating required to provide a desired degree of strength would be less than would otherwise be required to form a bead having the same degree of strength.

In further embodiments the amount of thermoplastic coating applied to the plush surface of the fabric strip may be reduced by applying the thermoplastic coating so as to extend across only half the width of the plush surface of the fabric strip.

In embodiments where, for example, it is intended to fold the resultant textile element at a later stage during attachment of the textile element to a garment, the thermoplastic coating may be applied to the plush surface of the fabric strip so as to include a centrally located opening extending through the coating. Once the thermoplastic coating is allowed to cool and rigidify, the opening provides an effective fold-line. Not only does the opening facilitate folding of the resultant textile element, should it be required at a later stage, but the creation of a textile only edge along the fold line helps to improve wearer comfort.

Regardless of whether the thermoplastic coating extends across the entire width of the plush surface, or across half the width of the plush surface or includes a centrally located opening therein, folding of the resultant textile element may be achieved at a later stage, during attachment of the textile element to a garment, for example, by heating the resultant textile element to soften the thermoplastic coating and then folding the fabric strip so as to encase the thermoplastic material.

This arrangement reduces the risk of contaminants becoming adhered to the thermoplastic coating, and also reduces the risk of injury to a user that might otherwise occur if the softened thermoplastic coating is brought into direct contact with the user's skin. Such users include a person involved in securing the textile element to a garment.

The shape of the resultant textile element may be further improved by applying pressure to the fabric strip and the thermoplastic coating whilst allowing the thermoplastic coating to cool and rigidify. This ensures the formation of a flat surface for contact with a wearer's skin.

In order to form a plurality of textile elements, the fabric element and the plush surface may have a length suitable for forming two or more textile elements and the thermoplastic coating may be applied length wise along the plush surface so as to include breaks in the thermoplastic coating at predetermined intervals along the length of the plush surface.

It will be appreciated that the thermoplastic coating could in other embodiments be applied continuously along the length of the plush surface. The inclusion of breaks in the thermoplastic coating is however advantageous in that it facilitates cutting of the fabric strip more easily so as to create individual textile elements having a desired length after allowing the thermoplastic coating to cool and rigidify.

Preferably, in such embodiments, the fabric strip and the plush surface would have a length sufficient to form two, three or more structural components—for example, 2 or 3 or 4 or 5 or 6 or 7 or 8 or 9 or 10 or 20 or 30 or 50 or 100 or more textile elements. Consequently if it is desired to form three textile elements, each having a length of 20 cm, the fabric strip and plush surface would have to have a length of 60 cm or more.

Where the thermoplastic coating is applied as a non-continuous coating with each separate region located between adjacent breaks in the thermoplastic coating defining a textile element, each region may be applied to have a length required to form a textile element for use as a structural support component in a garment—for example, a length of approximately 15 cm or approximately 18 cm or approximately 20 cm or approximately 22 cm or approximately 24 cm or approximately 26 cm or approximately 28 cm or approximately 30 cm or approximately 32 cm or approximately 34 cm or approximately 36 cm or approximately 38 cm or approximately 40 cm.

So as to create curved textile elements having a predetermined diameter of curvature, the method of the invention may further include the step of coiling the fabric strip before the thermoplastic coating rigidifies so as to set the fabric strip in a helical coil structure having a predetermined diameter.

Preferably the diameter of the helical coil structure is chosen so that each circle or coil of the helical coil structure forms at least one textile element. It will be appreciated that each such textile element will be curved and that the curvature will be defined by the diameter of the circle or coil—preferably, the coiling and setting process being performed to create a textile element having a curvature that renders it suitable for direct incorporation in a garment. It will be appreciated that garments of different sizes may require textile elements having different curvatures and thus textile elements for different sized garments may be formed by coiling and setting the fabric strip so as to create circles or coils of different diameters.

It is particularly preferred that the diameter of each circle or coil in the helical coil structure is between 10 cm and 50 cm, for example, 10 cm or 15 cm or 20 cm or 25 cm or 30 cm or 35 cm or 40 cm or 45 cm or 50 cm.

The step of coiling and setting the fabric strip into a helical coil structure may be performed by feeding the fabric strip into a screw thread provided in or on a mould. The fabric strip could for example be fed into a screw thread provided about the outer circumference of a cylinder or rod. The step of feeding the fabric strip into the screw thread may be achieved by rotating the mould so as to rotate the screw thread so as to force the fabric strip around and along it, defining a helical coil structure. Alternatively, the step of feeding the fabric strip into the screw thread may be achieved through the use of a belt arranged around the mould and driven about the mould so as to drive the fabric strip into the screw thread.

Advantageously, the thermoplastic coating cools and rigidifies whilst the fabric strip is held in a helical coil shape so as to set the fabric strip in that shape and allow the fabric strip to retain a helical coil shape when removed from the screw thread. Such an approach is advantageous as it allows the continuous production of a coiled fabric strip.

To assist in the formation of a helical coil structure, the mould may be heated so as to heat the fabric strip and thermoplastic coating before allowing the fabric strip and thermoplastic coating to cool and rigidify so as to set the fabric strip in the helical coil structure.

Where the step of coiling and setting the fabric strip into a helical coil structure is performed using a screw thread, it will be appreciated that the diameter of the screw thread will define the diameter of the circles or coils in the resulting helical coil structure. Thus, if the desired diameter of each circle or coil in the helical coil structure is 10 cm or 15 cm or 20 cm or 25 cm or 30 cm or 35 cm or 40 cm or 45 cm or 50 cm, then a screw thread having a diameter of 10 cm or 15 cm or 20 cm or 25 cm or 30 cm or 35 cm or 40 cm or 45 cm or 50 cm, respectively, must be used.

The production of a helical coil structure is particularly advantageous in that it permits large quantities of textile element to be manufactured in a continuous process. The resulting helical coil structure is also a convenient size and shape for storage, packaging and transportation, and can be easily cut to generate textile elements that can be directly incorporated into garments.

Optionally the method may further include the step of cutting the coiled fabric strip to generate individual textile elements. If the method has been performed by applying the thermoplastic coating as a continuous coating along the length of the plush surface, the resulting coiled fabric strip may be cut anywhere along its length to create a textile element of desired length.

Alternatively, if the method has been performed by applying the thermoplastic coating as a non-continuous coating so as to form separate regions of thermoplastic coating, each defining an individual textile element, the resulting coiled fabric strip may be cut between separate regions of the thermoplastic coating to generate a textile element. This results in the creation of textile elements having a textile-only region at each end. This in turn greatly increases wearer comfort when the textile element is incorporated into a garment, such as a brassiere. This is because it reduces the discomfort that might otherwise be caused by a hardened end digging into a wearer's skin, the textile-only regions providing a cushioning effect at each end of the textile element.

It is envisaged that the plush surface of the fabric strip may be created by any method resulting in the creation of long, soft nap or raised pile.

More specifically, in embodiments of the invention, the fabric strip may have a woven structure in which the plush surface is created by the use of textured warp yarns in the woven structure at the plush surface.

In other embodiments, the fabric strip may have a woven structure in which the plush surface is created by reducing the number and/or thickness of weft yarns when compared to the number and/or thickness of weft yarns when compared to the number and/or thickness of warp yarns so as to increase exposure of the warp yarns in the woven structure at the plush surface.

In further embodiments, the fabric strip may have a woven structure in which the plush surface is created by arranging warp yarns to form floating warp yarns passing over two or more weft yarns at a time as to increase exposure of the warp yarns in the woven structure at the plush surface. That is to say, the warp yarns may be arranged to pass over two or three or four or five weft yarns before passing under one weft yarn and then again passing over two or three or four or five weft yarns, and so on.

It is envisaged that in yet further embodiments of the invention, the fabric strip may have a knitted structure.

It is not necessary for the fabric strip to exhibit any stretch. This is because, in the event any heating and shaping of the fabric strip and thermoplastic coating is required to produce a textile element having a desired shape, it is possible to shape the fabric strip without any puckering of the fabric strip. In embodiments of the invention however it is envisaged that the fabric strip may exhibit stretch.

It is also not necessary, unlike in the applicant's Fortitube® product, to include a fusible yarn, such as Grilon™ K-85, in the plush surface of the fabric strip. This is because there is no requirement in the resultant textile element to allow for the creation of a penetration barrier.

In embodiments of the invention the fabric strip may be a separate component that may then be attached to an internal or external surface of a garment, or may be incorporated between layers of a garment.

It will also be appreciated that the method of the invention could be used in the manufacture of a garment component requiring the inclusion of a structural support component—for example, a cup for a brassiere could be manufactured for subsequent incorporation into a garment, the cup incorporating a textile element to act as a structural support component when incorporated into the garment.

Such a method allows the creation of garment components of a predetermined shape that may then be secured to a garment at a later stage as opposed to during formation of the garment component.

Whilst this method means that it is not possible to tailor each textile element to the specific garment in which it is to be used, it allows a stock of structural support components to be made in advance for later use during the manufacture of garments. This may be of particular benefit for garments made from delicate fabric that might otherwise become damaged by heat radiating from the molten thermoplastic material, even when the molten thermoplastic material is encased within the fabric strip.

In other embodiments of the invention it is envisaged that the fabric strip may be an integral component of a garment such as, for example, a brassiere or a dress or a bustier or a corset, in which case the thermoplastic coating is applied directly to a plush surface of a fabric of a garment, either before, during or after the process of manufacturing the garment.

The resulting garment may have the thermoplastic coating on an exterior surface (i.e. on an outer surface of the garment), or the thermoplastic coating may be within the garment construction, such that it is on an interior surface (i.e. on an inner surface of the garment) and is entirely covered by, or encased between, one of more fabric parts of the garment.

It will be appreciated therefore that the method of the invention could be used in the manufacture of any garment requiring a structural support component. Whilst particular reference is made herein to the use of the resultant textile element as a structural support component in a brassiere, it is envisaged that it could be used in other undergarments to provide support for a wearer's breasts. It is also envisaged that the resultant textile element could be used as a structural support component in other garments such as, for example, dresses or bustiers that often require the inclusion of stiffening members, commonly referred to as bones, to maintain the shape and structure of the garment.

In embodiments where the fabric strip is an integral component of a garment or a garment component, the step of applying the thermoplastic coating to the plush surface of the fabric strip and allowing the thermoplastic coating to cool and rigidify, may be performed during the process of forming the garment. In such embodiments, the thermoplastic coating may be applied to the plush surface and allowed to cool and rigidify, the resulting textile element then being incorporated into the garment, for example, by being affixed to other garment components. Such an approach allows the textile element to be formed at any stage during the process of manufacturing a garment.

In either case, whether or not the fabric strip is a separate component or an integral component of a garment, the thermoplastic coating may be applied directly to the plush surface in a desired shape or pattern such that, when it is allowed to cool and rigidify, it forms a textile element having the desired shape or pattern for use as a support component.

In embodiments of the invention where the fabric strip is a separate component, the method may further include the step of incorporating the resultant textile element into a garment so as to form a structural support component, for example, by affixing the resultant textile element to one or more other garment components in order to form the garment.

In such embodiments, the resultant textile element may be located on the exterior of the garment—that is, on an exterior surface (i.e. on an outer surface) of the garment. It will be appreciated that locating the thermoplastic coating on the exterior of a garment is convenient because it allows the textile element to be added to an existing garment so as to add a structural support component to the garment. Thus, the method of the invention includes adding or otherwise incorporating the resultant textile element into an existing garment as well as incorporating the resultant textile element into a garment during manufacture of the garment. It is however preferred, where possible, that the step of applying the thermoplastic coating to a plush surface of the fabric strip, and allowing the thermoplastic coating to cool and rigidify, is performed after the process of forming the garment.

It will be appreciated that it may be desirable for the thermoplastic coating not to be located on the exterior of the garment, where it may be visible to the wearer or come into contact with the wearer's skin and/or clothing.

In other embodiments therefore the resultant textile element may be incorporated into a garment so that the thermoplastic coating is located within the garment—that is, within the garment construction such that it is on an interior surface (i.e. on an inner surface of the garment) and is entirely covered by, or is encased between, one or more fabric parts of the garment. Such an arrangement results in a garment that is more aesthetically pleasing (because the thermoplastic coating is not visible to the wearer) and/or a garment that is more comfortable (because the thermoplastic coating does not come into contact with the wearer's skin and/or other clothing).

Preferably the method involves encasing the resultant textile element between two fabric surfaces of a garment that includes two or more fabric surfaces.

One such well known process for forming a garment involves assembling and affixing multiple fabric layers to one another using an adhesive. Typically, individual fabric layers constituting at least a top part and a bottom part of the garment are affixed to one another using an adhesive—in some instances, additional garment components are arranged between the top and bottom fabric layers so that they are incorporated between them, and are affixed within the resulting garment. Such processes are referred to as "lamination" by those in the art, and are frequently used in the manufacture of undergarments, such as brassieres.

Lamination typically involves powder-coating a surface of one or more fabric layers to be affixed to one another with an adhesive. Typically, the adhesive used in lamination approaches has a melting temperature of between 90° C. to 160° C. or between approximately 90° C. to approximately 160° C. Lamination is therefore performed by heating the fabric layers to a temperature that is sufficient to melt the adhesive (for example, at a temperature between 90° C. to 160° C. or between approximately 90° C. to approximately 160° C., depending on the melting point of the particular adhesive being used) and then contacting them with one another under pressure and allowing the fabrics and adhesive to cool. As the adhesive cools and sets, the contact fabric layers adhere to one another. In some instances, additional garment components may be arranged between the fabric layers so that those components are incorporated between them, and are thereby affixed within the garment.

Accordingly the method of the invention includes the step of incorporating the resultant textile element into a garment by laminating the resultant textile element to one or more other garment components.

In one such embodiment, the method may involve encasing the resultant textile element between two fabric parts of a garment that are then laminated together such that the resultant textile element is secured between two laminated fabrics of the garment.

In another embodiment in which the fabric strip is an integral part of the garment, the method may involve applying the thermoplastic coating to a plush surface of the fabric of the garment and subsequently folding the fabric around the thermoplastic coating, such that the fabric encases the thermoplastic coating. In such embodiments the thermoplastic coating may be allowed to cool and rigidify before or after the step of folding the fabric around the thermoplastic coating.

Where lamination is used in the method of the invention to form a garment, the heating step used to adhere the fabric layers to one another during the lamination process may be performed either: (i) at a temperature sufficient to soften and/or melt the thermoplastic coating; or (ii) at a temperature which is not sufficient to soften and/or melt the thermoplastic coating.

In the case of (i), where the temperature used during the lamination process is sufficient to soften and/or melt the thermoplastic coating, the garment (and/or the fabric having the thermoplastic coating) may be moulded into a required shape so that, on cooling, the garment (and/or fabric having the thermoplastic coating) retains that required shape. Such embodiments permit the formation of three-dimensional shapes within a garment.

In the case of (ii), where the temperature used during the lamination process is not sufficient to soften and/or melt the thermoplastic coating, the garment (and/or the fabric having the thermoplastic coating) will retain its shape and will not be moulded during the laminating process. That may be beneficial where the thermoplastic coating is already formed into the required shape, and no further modifications to it need to be made during the laminating process.

A skilled person will be capable of selecting an appropriate thermoplastic coating, laminating adhesives and lamination temperatures to achieve the embodiments discussed in (i) and (ii) above.

Adhesives used in the lamination typically have a melting temperature of between 90° to 160° C. or between approximately 90° C. to approximately 160° C., and lamination is therefore performed by heating the fabric layers to a sufficient temperature to melt that adhesive (for example, at a temperature between 90° to 160° C. or between approximately 90° C. to approximately 160° C.). As discussed above, it is preferred that the thermoplastic coating melts at a temperatures greater than 100° C. or approximately 100° C. and preferably at temperatures greater than 150° C. or approximately 150° C. In other words, the melting temperature of the thermoplastic coating may be greater than 100° C. or approximately 100° C., and preferably greater than 150° C. or approximately 150° C.

Accordingly, embodiment (i) could be achieved, for example, by selecting an adhesive which melts at a temperature of 130° C. or approximately 130° C. and selecting a thermoplastic coating which melts at a temperature of 150° C. or approximately 150° C., and performing the lamination at a temperature between 150° C. and 160° C. or between approximately 150° C. and approximately 160° C. Alternatively, embodiment (i) could be achieved, for example, by selecting an adhesive which melts at a temperature of 120° C. or approximately 120° C. and selecting a thermoplastic coating which melts at a temperature of 140° C. or approximately 140° C., and performing the lamination at a temperature between 140° C. and 160° C. or between approximately 140° C. and approximately 160° C.

Embodiment (ii) could be achieved, for example, by selecting an adhesive which melts at a temperature of 130° C. or approximately 130° C. and selecting a thermoplastic coating which melts at a temperature of 150° C. or approximately 150° C., and performing the lamination at a temperature between 130° C. and 140° C. or between approximately 130° C. and approximately 140° C. Alternatively, embodiment (ii) could be achieved, for example, by selecting an adhesive which melts at a temperature of 90° C. or approximately 90° C. and selecting a thermoplastic coating which melts at a temperature of 150° C. or approximately 150° C., and performing the lamination at a temperature between 90° C. and 140° C. or between approximately 90° C. and approximately 140° C.

In a further embodiment in which the fabric strip is an integral part of the garment, the method may involve applying the thermoplastic coating to a plush surface of the fabric of the garment and another fabric may then be used to cover the thermoplastic coating so as to encase the thermoplastic coating between two fabric surfaces. In such an embodiment the two fabric surfaces may be secured together by a method other than laminating.

In embodiments in which a fabric covering the textile element is intended to contact a wearer's skin, the fabric covering may be flocked so as to present the flocked surface to the skin of a wearer and thereby improve the wearer's comfort.

Regardless of whether the fabric strip is a separate component or an integral component of a garment, the thermoplastic coating may be moulded into the shape required to form a textile element for use as a support component in a garment by heating the fabric strip and thermoplastic coating, and moulding the fabric strip and thermoplastic coating into the required shape so that, once the thermoplastic coating is allowed to cool and rigidify, the fabric strip retains the required shape. Such an approach permits the creation of tailor-made support components adopting two- or three-dimensional shapes.

The step of moulding the thermoplastic coating into the required shape may be performed after the step of applying the thermoplastic coating to the plush surface but before the thermoplastic coating is allowed to cool and rigidify.

It is also envisaged however that the step of moulding the thermoplastic coating into the required shape could be performed after the step of allowing the thermoplastic coating to cool and rigidify. In such embodiments heating of the thermoplastic coating would be required to soften the thermoplastic coating and allow moulding thereof.

In such embodiments, where the fabric strip is a separate component and the resultant textile element is intended to be used in a garment as a structural support component, the method may involve the step of securing a moulded textile element in position on a garment whilst the thermoplastic coating remains soft and before the thermoplastic coating is allowed to rigidify. This allows flexure of the textile element to ensure that it matches the shape required by the garment, thereby leading to the creation of a truly tailor-made support component. It also acts to hold the textile element in position during cooling of the thermoplastic coating and thereby ensures that the textile element maintains the required shape.

In such embodiments, the moulded textile element may be secured in position on the garment by means of sewing or by means of an adhesive.

The use of adhesive or stitches to secure the moulded textile element to the garment prevents detachment of the moulded textile element from the garment during cooling and rigidifying of the thermoplastic coating and ensures that the moulded textile element retains the required shape.

In such embodiments, whether the moulded textile element is secured to the garment by means of sewing or an adhesive, the method may further include the step of folding the fabric strip in half along its length prior to the step of moulding the fabric strip into the required shape. Folding the fabric strip serves to encase the thermoplastic coating and thereby protect the fabric of the garment when the moulded fabric strip is secured to the garment. The softened thermoplastic coating might otherwise damage the fabric of the garment when the moulded textile element is secured to the garment, particularly if the garment is made from a delicate fabric.

In other embodiments, where the fabric of the garment is less delicate or the risk of any potential damage to the fabric of the garment is less important, the step of folding the fabric strip may be omitted and the moulded textile element may be secured by laying the softened thermoplastic coating in face to face contact with the fabric of the garment.

In such embodiments, the step of sewing the moulded textile element to the garment may be dispensed with, the moulded textile element being secured to the garment by means of the softened thermoplastic coating adhering to the fabric of the garment and forming a permanent bond there between as the thermoplastic coating cool and rigidifies.

As discussed above, in embodiments where the resultant textile element is incorporated into a garment using a laminating process, the steps of heating the textile element so as to soften the thermoplastic coating, moulding the textile element into the required shape and allowing the thermoplastic coating to cool and rigidify, may be performed during the lamination process.

Alternatively the steps of heating the resultant textile element so as to soften the thermoplastic coating, moulding the textile element into the required shape and allowing the thermoplastic coating to cool and rigidify, may be performed after a garment incorporating the textile element as a structural support component has been formed.

So as to prevent re-melting of the thermoplastic coating following any subsequent heating and moulding to create a textile element having a shape required for use as a structural support component in a garment, the thermoplastic coating may be formed from a thermoplastic material that melts at temperatures greater than 100° C. or approximately 100° C., and preferably at temperatures greater than 150° C. or approximately 150° C. In other words, the melting temperature of the thermoplastic material used to form the thermoplastic coating may be greater than 100° C. or approximately 100° C., and is preferably greater than 150° C. or approximately 150° C.

In embodiments of the invention, the thermoplastic coating may be applied so as to have a thickness in the range of 0.1 mm-3.0 mm or approximately 0.1 mm to approximately 3.0 mm, and preferably a thickness in the range of 0.5 mm-3.0 mm or approximately 0.5 mm to approximately 3.0 mm, and preferably a thickness of 1.5 mm or approximately 1.5 mm so as to provide a textile element having the required strength and rigidity following any subsequent heating and moulding that may be required for use of the textile element as a structural support component in a garment. Optionally, the thermoplastic coating may be applied to the plush surface of the fabric strip to have a thickness in the range of:

- 0.8 mm to 2.7 mm or approximately 0.8 mm to approximately 2.7 mm; or
- 1.0 mm to 2.5 mm or approximately 1.0 mm to approximately 2.5 mm; or
- 1.0 mm to 2.0 mm or approximately 1.0 mm to approximately 2.0 mm; or
- 1.25 mm to 1.75 mm or approximately 1.25 mm to approximately 1.75 mm.

In other embodiments of the invention, the thermoplastic coating may be applied to the plush surface of the fabric strip so as to have a thickness in the range of 0.1 mm-3.0 mm or approximately 0.1 mm to approximately 3.0 mm, and preferably a thickness in the range of 0.5 mm-3.0 mm or approximately 0.5 mm to approximately 3.0 mm, and a width in the range of 6 mm-20 mm or approximately 6 mm to approximately 20 mm. In such embodiments, the resultant textile element resembles the dimensions of a conventional under-wires used to support wearers' breasts in garments such as brassieres.

It will be appreciated that a thicker thermoplastic coating will produce a textile element having greater strength and rigidity, which may be required and/or desired for use as structural support components in garments where greater structural support is needed (for example, in larger-sized brassieres where the wearer's body is larger and more support is needed).

In yet further embodiments, the thermoplastic coating may be applied to the plush surface of the fabric strip so as to have a thickness in the range of 0.1 mm-1.0 mm or approximately 0.1 mm to approximately 1.0 mm and a width in the range of 20 mm-50 mm or approximately 20 mm to approximately 50 mm.

It will be appreciated that in such embodiments, the thermoplastic coating does not resemble the dimensions of a conventional under-wire. Instead, the thermoplastic coating is applied with a thinner dimension than a conventional under-wire and over a larger area (i.e. with a larger width and length) than a conventional under-wire, in order to form a textile element having a broad support region for use as a structural support component in a garment.

In one such embodiment, the broad support region may be located, either by securing the resultant textile element or providing the plush surface and thermoplastic coating, adjacent to the part of the garment in which support is required—for example, where the garment is a brassiere, a support region may be located adjacent to each of the cups of the brassiere in order to provide support for the wearer's breasts when the brassiere is worn.

It will be appreciated that applying the thermoplastic coating with a thinner dimension and over a larger area than a conventional under-wire may result in improved comfort to the wearer and/or improvements in the aesthetic appearance of a garment.

Conventional under-wires will often twist and dig into the wearer when the cup supports the weight of a breast, causing discomfort—providing a broader support region allows the weight to be spread across a larger area of the wearer's body, reducing such discomfort. Furthermore, the dimensions of conventional under-wires mean that the location is often apparent in a garment, which many consumers regard as unattractive—producing a thinner textile element for use as a structural support component in a garment therefore improves the overall appearance of the resultant garment.

In a further such embodiment, the resultant textile element may be additionally moulded so that the textile element (and the resulting garment when the textile element is incorporated in the garment as a structural support component) adopts a three-dimensional shape. Again it will be appreciated that such an arrangement forms a broad support region within the moulded garment which provides improved comfort and/or improved aesthetic appearance, and that the three-dimensional shape provides better support to the wearer's body (for example, the breast) and/or improves the aesthetic appearance of the resultant garment and the wearer's body when it is worn.

In that further embodiment, the thermoplastic coating may be arranged in a region along one or more edge of the moulded garment, in order to provide a three-dimensional support region. For example, where the moulded garment is a moulded brassiere, the thermoplastic coating may be arranged in a region along one or more edge of each cup of the brassiere so that it will be adjacent to one or more side of each breast when the brassiere is worn and thereby provide support and/or shaping to a part or all of each breast.

In that further embodiment, it is also particularly preferred that the thermoplastic coating is arranged along the outer edge of each brassiere cup, thereby providing support and/or shaping to the side of the wearer's breasts to provide a "push up" function, which is known to be desirable to those skilled in the art. Preferably, the thermoplastic coating is arranged so that it does not cover the nipple of the wearer's breast when the garment is worn.

In that further embodiment, the thermoplastic coating may be arranged on an outer surface of the fabric of the moulded garment, or it may be on an inner surface of the moulded garment (i.e. within the garment construction). For example, where the garment has a laminated construction, the thermoplastic coating may be encased between two of the fabric parts of the garment which are laminated together, such that the structural support component is arranged between two of the laminated fabrics of the garment. Alternatively, the thermoplastic coating may be arranged on a surface of the fabric of the garment which is then subsequently covered by folding the fabric around the thermoplastic coating, such that the fabric encases the thermoplastic coating.

In that further embodiment, the moulded garment may comprise or consist of a textured fabric and/or a suede fabric. The moulded garment may comprise or consist of a single fabric layer, such as a spacer fabric (for example, the garment may be a single-layered fabric brassiere) or it may comprise or consist of a plurality of fabric layers (for example, the garment may be a multi-layered fabric brassiere). The moulded garment may include padding, such as foam padding (for example, the garment may be a padded brassiere).

The moulded garment may be a cut-and-sew garment, such as a cut-and-sew brassiere which has been moulded. Where the garment is a moulded cut-and-sew brassiere, the thermoplastic coating may be arranged in a layer that covers some or all of the seams of the cut-and-sew construction of the brassiere.

In that further embodiment, the moulded garment may be a moulded brassiere, a moulded basque, a moulded bustier, moulded swimwear or moulded nightwear.

The thermoplastic coating of the invention may be adapted to improve its breathability and comfort, by improving air flow through and/or around the thermoplastic coating. For example, the thermoplastic coating may further include a breathable portion, which may include at least one of:

- at least one through-hole extending through a thickness of the thermoplastic coating;
- at least one bump, pimple and/or dimple on a surface of the thermoplastic coating for defining one or more air gaps between the device and a body of a wearer;
- a textured surface for defining one or more air gaps between the thermoplastic coating and a body of a wearer;
- at least one fibre wicking through a thickness of the thermoplastic coating; and/or
- any other structure that defines one or more air gaps between the thermoplastic coating and a body of a wearer.

The size of the or each through-hole may be in the range of 100 μm to 2 mm. The size of the or each bump, pimple and/or dimple may be in the range of 100 μm to 2 mm.

The breathable portion may comprise or consist of at least one air-permeable material.

The breathable portion may extend across a surface of the thermoplastic coating facing a wearer's body.

Where the thermoplastic coating is arranged with a thinner dimension and over a larger area than a conventional under-wire (such as the exemplary dimensions discussed above), preferably a thickness of the outer portion of the thermoplastic coating decreases towards an outer edge that defines part or whole of a perimeter of the outer portion, such that the thickness of the outer edge is infinitesimally small. Those skilled in the art would recognise such an outer edge as an "infinity edge". In such an arrangement, the outer portion of the thermoplastic coating is flexible, which will inhibit formation of a visible outline of the thermoplastic coating through the garment fabric with which it is combined or associated.

The thermoplastic coating of the invention may vary in terms of colour and transparency. For example, the thermoplastic coating may have the same colour as the fabric and/or garment with which it is combined or associated, may be nude-coloured (i.e. have the same colour as a wearer's skin), or may be partially or fully transparent.

It is preferred that the broad support region described in the embodiments above is located adjacent to the part of the garment in which support is required—for example, where the garment is a brassiere, a support region may be located adjacent to each of the cups of the brassiere in order to provide support for the wearer's breasts when the brassiere is worn.

Methods for applying a thermoplastic coating to a plush surface of a fabric strip are known in the art. For example, molten thermoplastic material may be applied to form a coating by screen-printing onto the plush surface, or by extruding molten thermoplastic material onto the plush surface, or by otherwise laying molten thermoplastic material onto the plush surface (for example, by hand or using conventional robotic machinery).

It will be appreciated that, on the basis of the description set out above, the thermoplastic coating used in the present invention may include any type of plastic material that can be applied in a melted form as a coating to a surface, and subsequent cooled so that it rigidifies. Thus, thermoplastic coatings suitable for use in the invention include a coating made from a plastic material which can be re-melted after it has rigidified, and a coating made from a plastic material that cannot be re-melted after it has rigidified.

The thermoplastic material is preferably chosen so as to exhibit a shore d hardness in the range of 50 to 80, or approximately 50 to approximately 80 once it is allowed to cool and rigidify. More preferably, the thermoplastic material is chosen so as to exhibit a shore d hardness of 60 or approximately 60 once it is allowed to cool and rigidify. Most preferably, the thermoplastic material is chosen so as to exhibit a shore d hardness of 70 or approximately 70 once it is allowed to cool and rigidify.

Preferably, the thermoplastic coating is a polyamide, and is more preferably a polyester.

It is envisaged that in other embodiments, a material other than a thermoplastic material may be used to form a coating on the plush surface of the fabric strip. Other materials, such as thermosetting plastic materials or adhesives or epoxy resins for example, could be used to form a coating on the plush surface of the fabric strip. It will be evident to the skilled person what materials might be chosen to achieve the required penetration into the plush surface on application of the coating and formation of the required composite at the juncture between the plush surface. Materials exhibiting a shore d hardness within the range outlined above once cooled or cured so as to rigidify would be particularly suitable. Accordingly references herein to thermoplastic coating should be considered interchangeable with references, for example, to a thermosetting plastic coating.

In the event a thermosetting plastic material is used, curing of the material once it is applied may be achieved through the application of heat or through a chemical reaction (two-part epoxy, for example) or through irradiation (UV radiation or electron beam processing, for example).

According to a second aspect of the invention there is provided a textile element for use as a structural support component in a garment, the textile element comprising a fabric strip having a plush surface and a thermoplastic coating applied to the plush surface so that at least surface yarns of the plush surface are embedded in the thermoplastic coating and form a composite structure at the juncture between the thermoplastic coating and the plush surface.

Penetration of the thermoplastic coating into the plush surface and the formation of a composite structure in which yarns are embedded in the thermoplastic coating greatly increases the strength and flexibility of the resultant textile element over and above a textile element formed from a thermoplastic material applied to a non-plush surface of a textile carrier, as outlined above.

The provision of a thermoplastic coating allows the textile element to be moulded into a shape required to form a structural support component once the textile element is heated to soften the thermoplastic coating, the textile element retaining the required shape once the thermoplastic is allowed to cool and rigidify. This in turn allows the creation of tailor-made structural support components adopting two- or three-dimensional shapes once moulded.

Whilst it is envisaged however that a textile element according to the invention may be heated to soften the thermoplastic coating and allow the textile element to be moulded into a required shape, it is also envisaged that a textile element according to the invention may be secured directly to a garment without softening the thermoplastic coating to mould the shape of the textile element.

A flat and straight textile element may be flexed during securing of the textile element to the garment so as to follow the shape of the garment at the location requiring support. The provision of the thermoplastic coating on the fabric strip of the textile element will provide the required support and the resilient nature of the textile element, which will cause the textile element to resume its flat configuration and will this cause flexing of the textile element. It will be appreciated that the garment to which the textile element is attached will resist this flexing movement and will cause the textile element to assume a three-dimensional shape, which in turn will further enhance wearer comfort if the textile element is attached in a direction so as to ensure that the resultant flexure is directed to follow the curve of a wearer's body.

The textile element is particularly suited for use in the manufacture of brassieres in order to provide the required support for wearer's breasts and thereby replace the under-wire conventionally used in such garments.

Use of the textile element according to the invention allows the creation of a tailor-made support component for each brassiere. It also allows the resultant structural support component to be secured directly to the fabric and obviates the risk otherwise associated with under-wires that are often made from steel and are prone to protrude from one or both ends of a bra wire pocket and cause wearer discomfort.

The protrusion of a conventional under-wire from one or both ends of a bra wire pocket is exacerbated by movement of the under-wire in the pocket. This movement is required to improve wearer comfort as a result of the generally fixed two-dimensional shape of conventional under-wires. The use of a thermoplastic coating avoids the need for any such movement in garments, such as brassieres, incorporating a structural support component formed using the textile element according to the invention. This is because the thermoplastic coating allows the fabric strip to be moulded into any desired shape and allows the creation of a three-dimensionally shaped support component that may be fixed directly to a garment and does not require the provision of a pocket having closed ends to allow movement of the support component relative to the garment.

The use of a thermoplastic coating also results in the creation of a structural support component that exhibits strength that is comparable to that of a conventional under-wire but which is more flexible and thus provides greater wearer comfort.

As outlined above, the flexibility of the textile element is determined by the extent to which the thermoplastic coating penetrates the plush surface. In particularly preferred embodiments, the fabric strip is a woven structure and the thermoplastic coating is applied to the plush surface so that the warp yarns of the plush surface are embedded in the thermoplastic coating in the composite structure.

Such a degree of penetration of the thermoplastic coating into the plush surface of the fabric strip could result in a textile element in which the thermoplastic coating is exposed on the opposite side of the fabric strip. Consequently, in such embodiments, the fabric strip preferably includes a more densely woven backing to the plush surface. The more densely woven backing prevent penetration of the thermoplastic coating through the entire depth of the fabric strip during manufacture of the textile element.

The increased flexibility of the resultant textile element means that the textile element will return to its original shape upon flexing, unlike a conventional under-wire for a brassiere, for example, which is relatively inflexible and likely to remain in a bent configuration following bending or flexing. The use of a thermoplastic coating encasing at least the surface yarns of a plush surface of the fabric strip thus results in the creation of a structural support component that exhibits strength comparable to that of a conventional under-wire but which is more flexible and thus provides greater wearer comfort.

In a particularly preferred embodiment of the invention the thermoplastic coating penetrates the plush surface so as to produce a substantially elastic textile element once the thermoplastic coating is allowed to cool and rigidify. This is to say, the textile element will flex or bend upon application of a force tending to cause flexure or bending. It will then return automatically to its original shape once the force causing flexure or bending is removed.

Other advantageous features of the textile element are set out in dependent claims 31 to 50.

A textile element 10 according to a first embodiment of the invention is shown in FIGS. 1*a* and 1*b*, the textile element 10 comprising a fabric strip 12 having a thermoplastic coating 14 extending length wise along a plush surface 16 of the fabric strip 12 (FIG. 1*a*).

So as to create the plush surface 16, which has a long, soft nap or raised pile, the fabric strip 12 is a woven structure in which the plush surface 16 is created by the use of textured yarns (not shown) in the woven structure at the plush surface 16.

In other embodiments the fabric strip 12 may have a woven structure in which the plush surface 16 is created by reducing the number and/or thickness of weft yarns when compared to the number and/or thickness of warp yarns in the woven structure at the plush surface 16. This arrangement increases the exposure of the warp yarns in the woven structure at the plush surface 16 and thus produces the required nap or pile.

In yet further embodiments the fabric strip 12 may have a woven structure in which the plush surface 16 is created by arranging warp yarns to form floating warp yarns passing over two or more weft yarns at a time so as to increase exposure of the warp yarns in the woven structure at the plush surface 16.

In yet further embodiments the fabric strip 12 may have a knitted structure.

The provision of a plush surface 16 on the fabric strip 12 means that, during application of the thermoplastic coating 14, molten thermoplastic material absorbs and penetrates into the plush surface 16 and coats the yarns of the plush surface 16. Once the thermoplastic coating 14 is allowed to cool and rigidify, the yarns of the plush surface 16 become embedded in the thermoplastic coating 14 and form a composite structure at the juncture J between the thermoplastic coating and the plush surface 16.

Penetration of the thermoplastic coating 14 into the plush surface 16 and the formation of a composite structure in which the yarns are embedded in the thermoplastic coating 14 increases the strength and flexibility of the textile element 10 over and above a textile element formed from a thermoplastic material applied to a non-plush surface of a textile carrier, as outlined above.

The textile element 10 produces a substantially elastic response when subjected to a force tending to cause flexure or bending. This is to say, the textile element 10 will flex or bend upon application of a force tending to cause flexure or bending and will return automatically to its original shape once the force causing flexure or bending is removed.

The use of a fabric strip 12 having a plush surface 16 helps to prevent leakage of molten thermoplastic material during application of the thermoplastic coating 14 because it allows the molten thermoplastic material to penetrate therein and thereby restrains flow of the molten thermoplastic material.

In the embodiment shown in FIGS. 1*a* and 1*b* the thermoplastic coating 14 extends width wise across the plush surface 16 of the fabric strip 12 and includes a centrally located opening 18 extending length wise through the coating 14.

The textile element 10 is flocked on an opposite surface 20 of the fabric strip 12 to the thermoplastic coating 14, the flocking 22 extending length wise of the opposite surface 20 and extending across half the width of the opposite surface 20 of the fabric strip 12.

The provision of flocking on the opposite surface of the fabric strip 12 prevents exposure of the thermoplastic coating 14 on the opposite surface of the fabric strip 12. In other embodiments, the fabric strip 12 may include a more densely woven backing to the plush surface 16 so as to prevent penetration of the thermoplastic coating 14 through to the opposite surface of the fabric strip 12.

The application of the thermoplastic coating 14 on the plush surface 16 of the fabric strip 12 may vary in other embodiments of the invention.

Figure 2A:
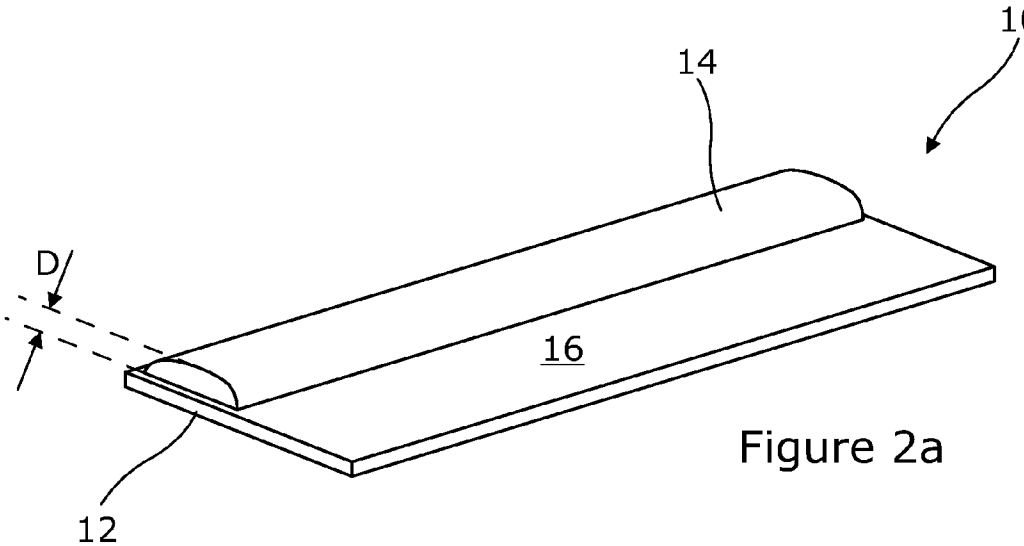
FIGS. 2*a* and 2*b* show opposite sides of a textile element according to a second embodiment of the invention.
Figure 2B:
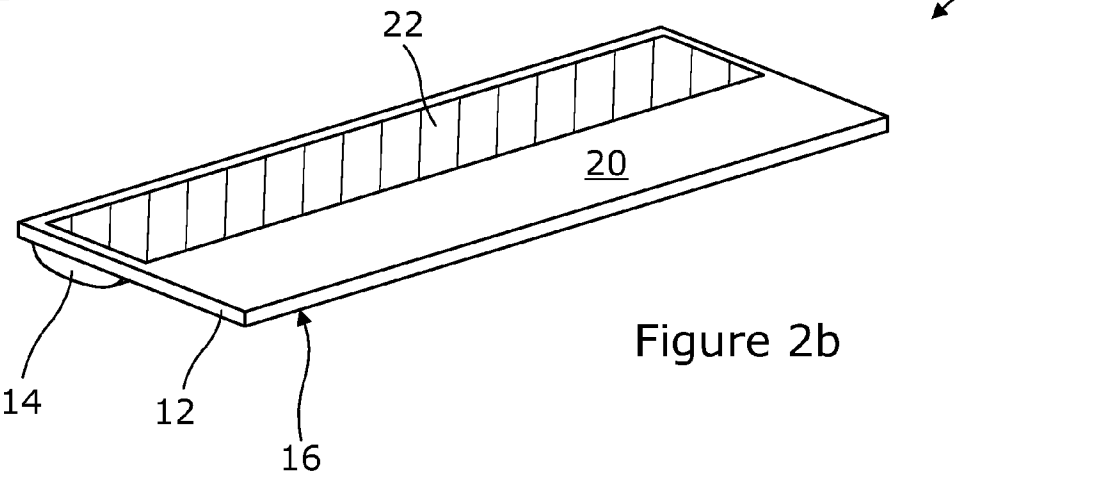

In a second embodiment of the invention, shown in FIGS. 2*a* and 2*b*, the textile element 10 includes a thermoplastic coating 14 applied so as to extend across half of the width of the plush surface 16 of the fabric strip 12.

The textile element 10 shown in FIGS. 2*a* and 2*b* includes flocking 22 on the opposite surface 20 of the fabric strip 12, the flocking 22 extending length wise of the opposite surface 20 and extending across half the width of the opposite surface 20 of the fabric strip 12, in a similar manner to the flocking 22 applied to the textile element 10 shown in FIGS. 1*a* and 1*b*.

In other embodiments of the invention, the textile element 10 may further include an adhesive coating on the opposite surface 20 of the fabric strip 12. A textile element 10 according to a third embodiment of the invention, including an adhesive coating on the opposite surface 20 of the fabric strip 12, is shown in FIGS. 3*a* and 3*b*.

Figure 3A:
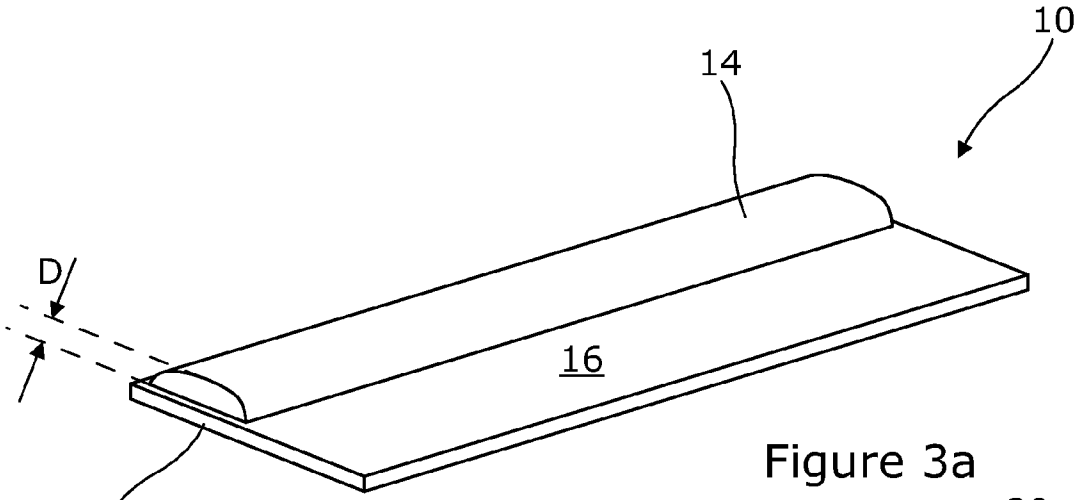
FIGS. 3*a* and 3*b* show opposite sides of a textile element according to a third embodiment of the invention.
Figure 3B:
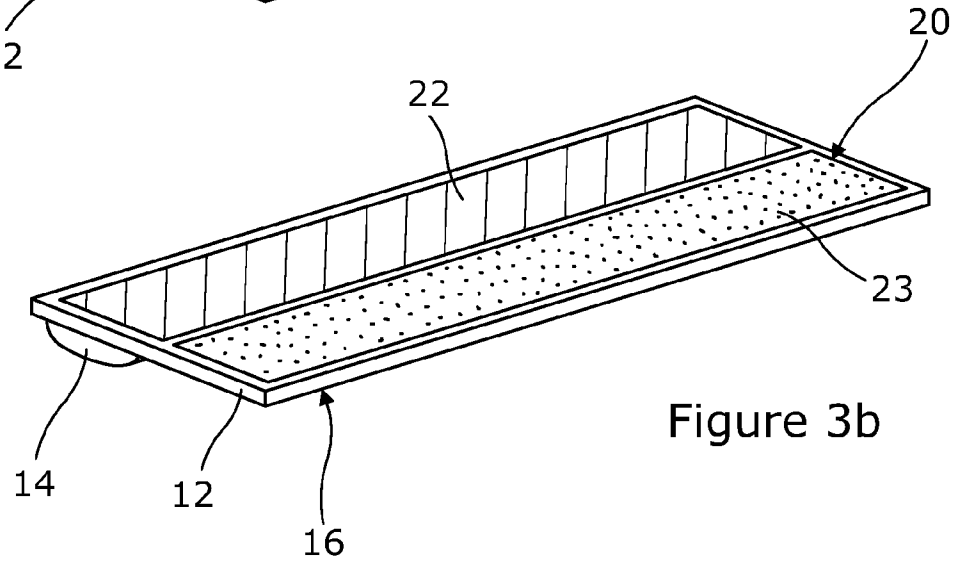

The textile element 10 shown in FIGS. 3*a* and 3*b* is similar to the textile element 10 shown in FIGS. 2*a* and 2*b* and so will not be described in detail. The textile element 10 shown in FIGS. 3*a* and 3*b* differs from the textile element 10 shown in FIGS. 2*a* and 2*b* only in that it includes an adhesive coating 23 on the opposite surface 20 of the fabric 12 strip.

The adhesive coating 23 extends length wise of the fabric strip 12 and across the other half of the opposite surface 20 of the fabric strip 12 to the flocking 22.

In other embodiments it is envisaged that the flocking 22 could be omitted and the adhesive coating 23 could extend width wise across the opposite surface 20 of the fabric strip 12. It is also envisaged that in another embodiment the textile element 10 shown in FIGS. 1*a* and 1*b* may be modified to include an adhesive coating 23 extending length wise and half way across the width of the opposite surface 20 of the fabric strip 12, adjacent the flocking 22.

Alternatively the embodiment shown in FIGS. 1*a* and 1*b* could be modified to omit the flocking 22 and include an adhesive coating 23 extending length wise and width wise across the opposite surface 20 of the fabric strip 12.

In other embodiments, the amount of flocking 22 applied to the opposite surface 20 of the fabric strip 12 of the textile element 10 may be varied.

Figure 4A:
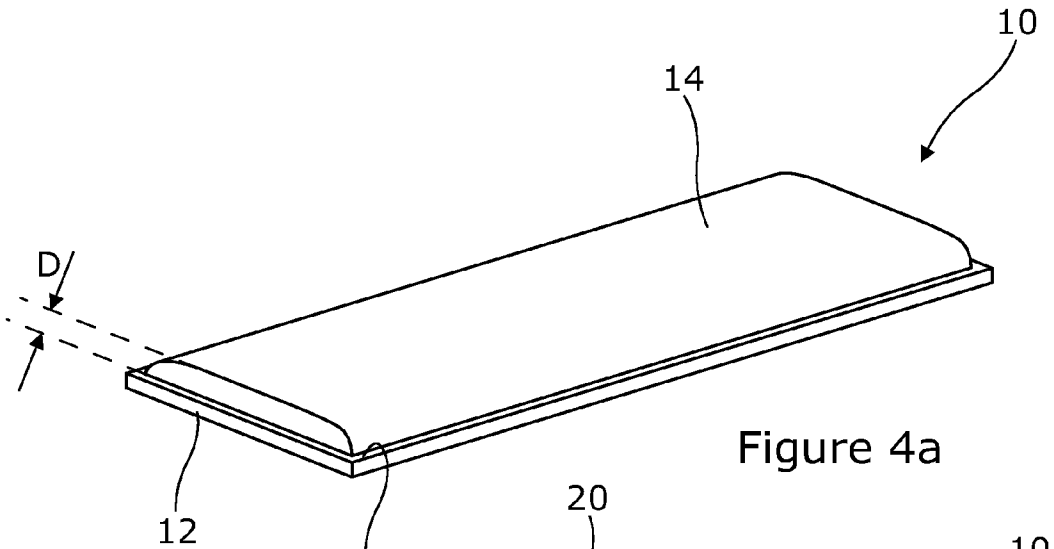
FIGS. 4*a* and 4*b* show opposite sides of a textile element according to a fourth embodiment of the invention.
Figure 4B:
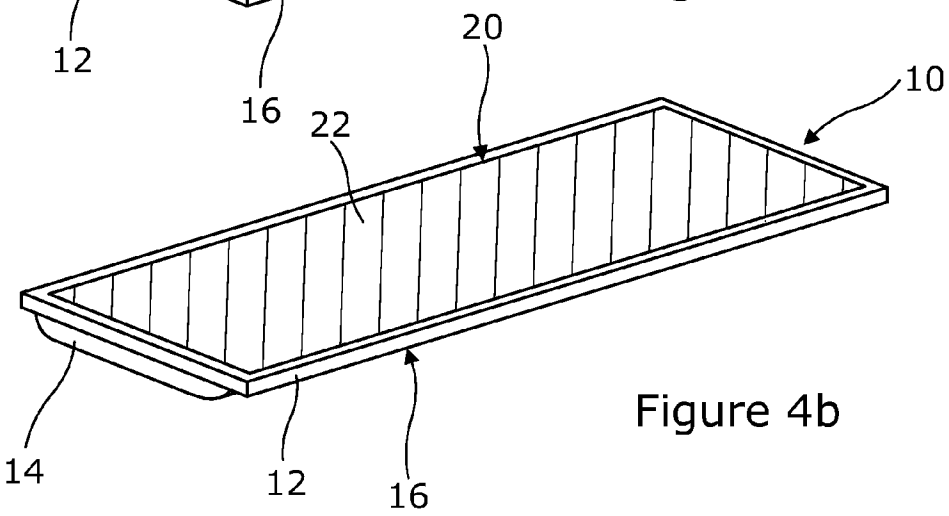

In a fourth embodiment of the invention, shown in FIGS. 4*a* and 4*b*, the textile element 10 includes a thermoplastic coating 14 applied so as to extend across the entire width of the plush surface 16 of the fabric strip 12.

The textile element 10 shown in FIGS. 4*a* and 4*b* includes flocking 22 on the opposite surface 20 of the fabric strip 12, the flocking 22 extending across the entire width of the opposite surface 20 of the fabric strip 12.

In other embodiments the textile element 10 shown in FIGS. 4*a* and 4*b* to include flocking 22 extending only half way across the opposite surface 20 of the fabric strip 12. It may also be further modified to include flocking 22 extending half way across the opposite of the fabric strip 12 and an adhesive coating 23 extending across the other half of the opposite surface 20 of the fabric strip 12. It may also be modified to exclude flocking 22 and to include an adhesive coating 23 extending half way across the width of the opposite surface 20 of the fabric strip 12 or an adhesive coating 23 extending width wise across the opposite surface 20 of the fabric strip 12.

Figure 5:
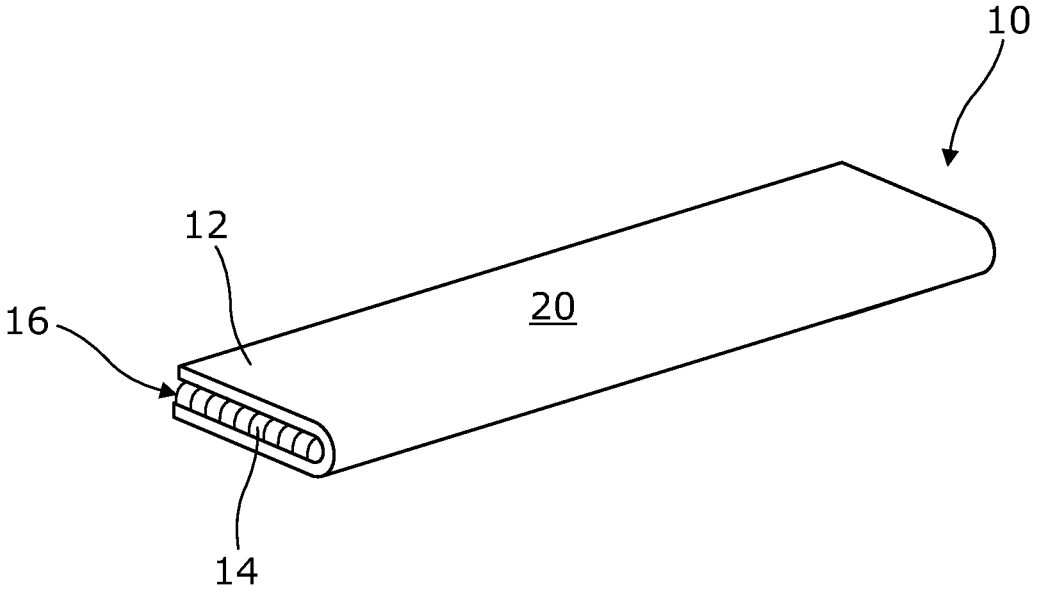
FIG. 5 shows opposite sides of a textile element according to a fifth embodiment of the invention.

A textile element 10 according to a fifth embodiment of the invention is shown in FIG. 5.

As in each of the first, second, third and fourth embodiments described above, the textile element 10 includes a fabric strip 12 having a thermoplastic coating on a plush surface 16 thereof. The fabric strip 12 is however folded in half length wise about the thermoplastic coating 14 so that the thermoplastic coating 14 is encased between the folded halves of the fabric strip 12.

In the embodiment shown in FIG. 5, the opposite surface 20 omits any flocking 22 or adhesive coating 23. It is envisaged however that in other embodiments, the textile element 10 shown in FIG. 5 may be modified to include flocking 22 and/or an adhesive coating 23 on the opposite surface 20 of the fabric strip 12, in a similar manner to that described in connection with the other embodiments described above.

In each of the first, second, third, fourth and fifth embodiments shown in FIGS. 1*a*, 1*b*, 2*a*, 2*b*, 3*a*, 3*b*, 4*a*, 4*b* and 5 the thermoplastic coating 14 has a thickness D of 1.5 mm. In other embodiments, the thermoplastic coating 14 may have a thickness of approximately 1.5 mm. In still other embodiments, the thickness of the thermoplastic coating 14 may be varied, depending on the strength and rigidity required by the thermoplastic coating 14, within the range of 0.1 mm-1.8 mm or approximately 0.1 mm to approximately 1.8 mm, and preferably within the range of 0.5 mm-1.8 mm or approximately 0.5 mm to approximately 1.8 mm.

The thermoplastic coating 14 in each of these embodiments is preferably a polyamide coating having a melting temperature in excess of 100° C. or approximately 100° C., and more preferably in excess of 150° C. or approximately 150° C. In other words, the melting temperature of the thermoplastic coating 14 is preferably greater than 100° C. or approximately 100° C., and even more preferably greater than 150° C. or approximately 150° C. The higher the melting temperature of the thermoplastic coating 14, the less likely the thermoplastic coating 14 is to melt during machine washing of a garment incorporating the textile element 10 as a structural support component.

In other embodiments the thermoplastic coating 14 may be a polyester coating having a similar melting temperature.

The use of the textile element 10 shown in FIGS. 2*a* and 2*b* to add a structural support component to a garment will now be described with reference to FIGS. 6*a* to 6*c*.

Figure 6A:
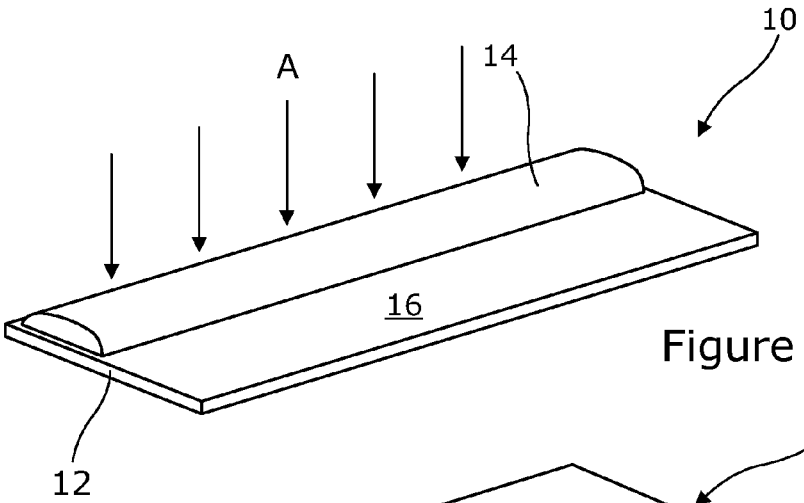
FIGS. 6*a*-6*c* illustrate a method of adding a structural support component to a garment using the textile element shown in FIGS. 2*a* and 2*b;*

As a first step, the fabric strip 12 is heated, as illustrated by arrows A in FIG. 6*a*, to soften the thermoplastic coating 14.

Figure 6B:
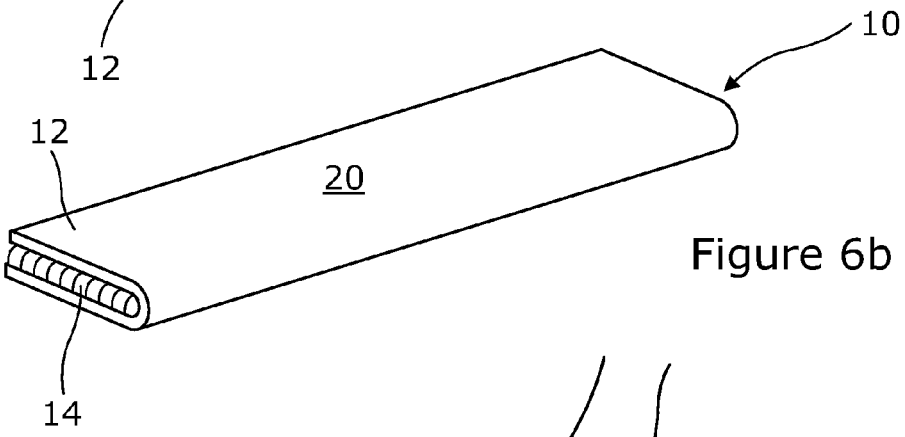

The fabric strip 12 is then folded in half along its length so as to encase the softened thermoplastic coating 14 within the fabric strip 12, as shown in FIG. 6*b*, before moulding the fabric strip 12 into the shape required by the structural support component.

Once moulded into the required shape, the moulded fabric strip 12 is secured in position on a garment 24 by means of sewing before being allowed to cool so as to allow the thermoplastic coating 14 to solidify in the required shape and form the structural support component 26. As shown in FIG. 6*c*, the moulded fabric strip 12 is secured to the garment 24 so that the flocking 22 is exposed. This arrangement ensures that when the garment 24 is worn, the flocking 22 contacts the wearer's skin and improves wearer comfort.

Securing the moulded fabric strip 12 to the garment 24, i.e. securing the textile element 10 to the garment 24, prior to cooling of the thermoplastic coating 14 allows further flexure of the thermoplastic coating 14 to the exact two- or three-dimensional shape required by the garment 24. It thus allows the final shape of the resultant support component to be tailored to match the specific garment in which it is incorporated. The stitches also ensure the moulded fabric strip 12 retains the required shape until solidification of the thermoplastic coating 14 and setting of the required shape is complete.

It is envisaged that in other embodiments the moulded fabric strip 12 may be secured to the garment 24 by means of an adhesive coating 23, such as that included on the opposite surface 20 of the fabric strip 12 of the textile element 10 in FIGS. 3*a* and 3*b* or by means of an adhesive applied directly between the moulded fabric strip 12 and the garment 24.

Figure 6C:
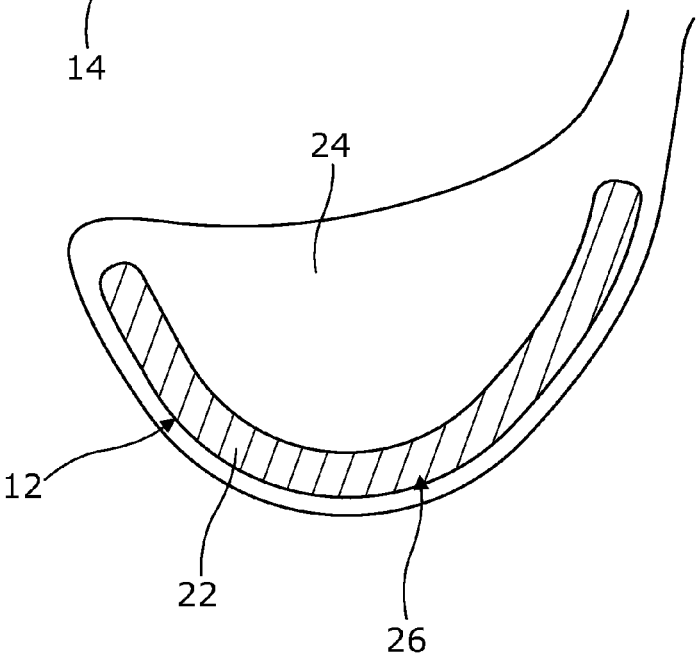

Preferably, although not illustrated in FIGS. 6*a* to 6*c*, pressure is applied to the moulded fabric strip 12 during cooling of the thermoplastic coating 14. The application of pressure ensures the formation of a flat surface for contact with a wearer's skin when the garment is worn and also further helps to ensure that the moulded fabric strip 12 retains the required shape during cooling of the thermoplastic coating 14.

In FIG. 6*c*, the moulded fabric strip 12 is shown attached to a cup of a brassiere. It is envisaged that the textile element 10 could be used in other garments requiring structural support components 26. The textile element 10 could for example be used in dresses or bustiers or corsets to define a stiffening member required to maintain the shape and structure of the garment.

It will be appreciated that in use of the textile element 10 shown in FIGS. 1*a* and 1 *b* the provision of a centrally located opening 18 extending length wise through the thermoplastic coating 14 will assist the folding step illustrated in FIG. 6*b*.

The provision of the centrally located opening 18 in addition allows the creation of opposing edges of the folded fabric strip 12 that do not contain thermoplastic coating 14 and thus present a softer edge than is otherwise created when thermoplastic coating 14 is enveloped by the fabric strip 12 along the fold line. It is envisaged that this will improve wearer comfort and reduce the risk of chaffing as a result of the otherwise relatively hard edge that might be created on folding the fabric strip 12.

In other embodiments the step of folding shown in FIG. 6*b* may be omitted. In use of the textile element 10 shown in FIGS. 4*a* and 4*b*, for example, the fabric strip 12 may be moulded into the required shape and then secured to the garment 24 with the molten thermoplastic coating 14 in face to face contact with the fabric of the garment 24.

In such embodiments the step of sewing the moulded fabric strip 12 to the garment 24 may also be omitted and the bond created between the molten thermoplastic coating 14 and the fabric of the garment 24 may be relied upon to secure the moulded fabric strip 12 to the garment 24.

The provision of flocking 22 across the entire width of the opposite surface 20 of the fabric strip 12, which is inevitably exposed when the molten thermoplastic coating 14 of the moulded fabric strip 12 is secured in face to face contact with the fabric of the garment 24, ensures that wearer comfort is maximised when the garment 24 is worn.

It is envisaged that in other methods, the textile element 10 shown in FIGS. 1*a*, 1*b*, 2*a*, 2*b*, 3*a*, 3*b*, 4*a*, 4*b*, 5*a* and 5*b* may be secured to a garment 24 to form a structural support component without heating the textile element 10 to melt the thermoplastic coating 14. The flat and straight fabric strip 12 may instead be flexed into the required shape whilst it is secured to the garment 24, either by means of sewing or adhesive.

Whilst it will be appreciated that securing the moulded fabric strip 12 to a garment 24 prior to cooling of the molten thermoplastic coating 14 allows the moulded fabric strip 12 to be tailored to match the specific shape of the individual garment 24, the textile element 10 may also be used to form structural support components for incorporation to garments at a later stage.

Figure 7A:
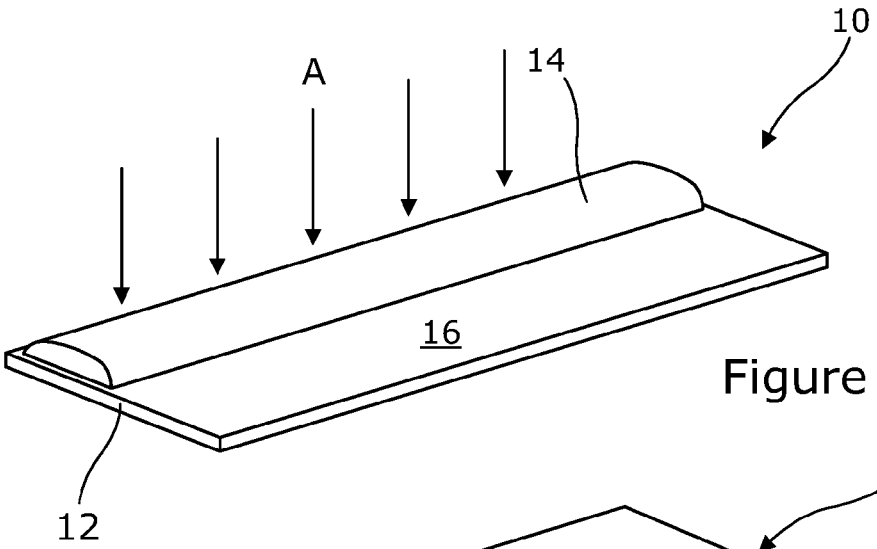
FIGS. 7*a*-7*c* illustrate a method of forming a structural support component using the textile element shown in FIGS. 2*a* and 2*b;*
Figure 7B:
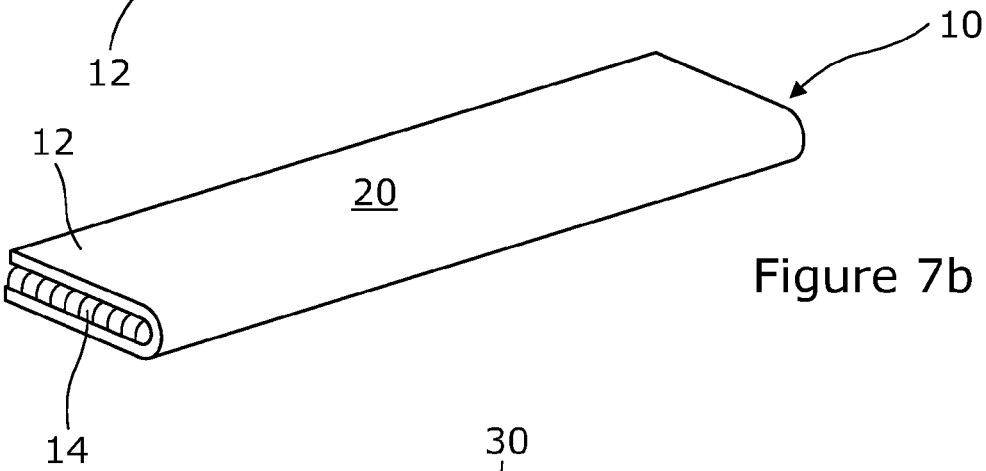
Figure 7C:
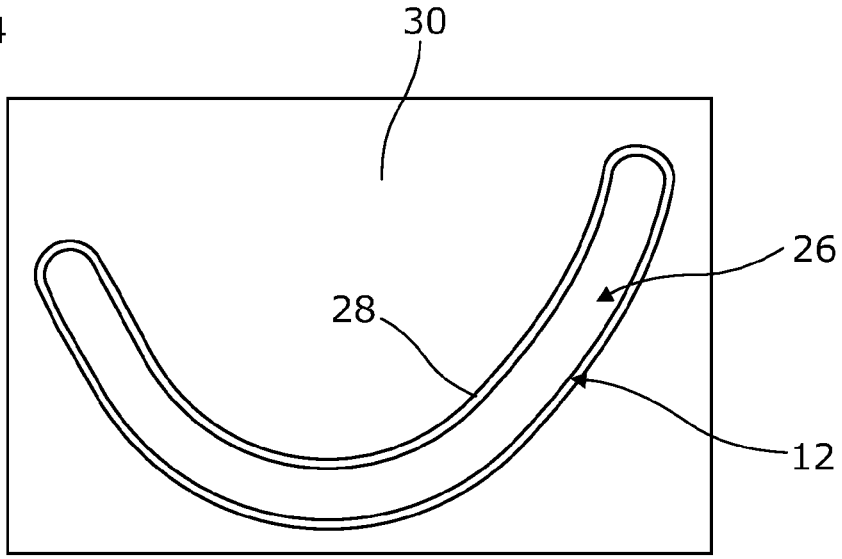

The formation of a structural support component 26 using the textile element 10 shown in FIGS. 2*a* and 2*b* is shown in FIGS. 7*a* to 7*c*.

As with the process illustrated in FIGS. 6*a* to 6*c*, the fabric strip 12 is heated so as to soften the thermoplastic coating 14 (FIG. 7*a*).

The fabric strip 12 is then folded to encase the softened thermoplastic coating 14 within the fabric strip 12 (FIG. 7*b*), before moulding the fabric strip 12 into the required shape.

The step of moulding the fabric strip 12 into the required shape is achieved in the embodiment illustrated in FIGS. 7*a* to 7*c* by placing the fabric strip 12 into a recess 28 defined in a mould 30 (FIG. 7*c*).

The use of the mould 30 ensures that the moulded fabric strip 12 retains the required shape during cooling of the thermoplastic coating 14.

Preferably, although not shown in FIG. 7*c*, the mould 30 includes a top plate that is applied over the moulded fabric strip 12 during cooling of the thermoplastic coating 14 so as to apply pressure to the moulded fabric strip 12. The application of pressure ensures the formation of a flat surface for contact with a wearer's skin when the resultant support component 26 is incorporated into a garment. It also further helps to ensure that the moulded fabric strip 12 retains the required shape during cooling of the thermoplastic coating 14.

It is envisaged that the elements of the mould 30 may in other embodiments be shaped so as to create a curved cross-sectional shape of the resultant structural support member 26.

It will also be appreciated that the elements of the mould 30 may be shaped to create a structural support member 26 having a three-dimensional shape. The application of pressure during cooling of the thermoplastic coating 14 does not limit the process to the formation of two-dimensionally-shaped structural support components 26.

In FIG. 7*c*, the moulded fabric strip 12 is shown moulded into the shape typically associated with the support components required for use in brassieres. It is envisaged however that the textile element 10 could be used to form structural support components 26 for use in other garments requiring structural support components. The textile element 10 could for example be used to create a structural support component 26 for use in a dress or bustier or corset in the form of a stiffening member to maintain the shape and structure of the garment.

Figure 7D:
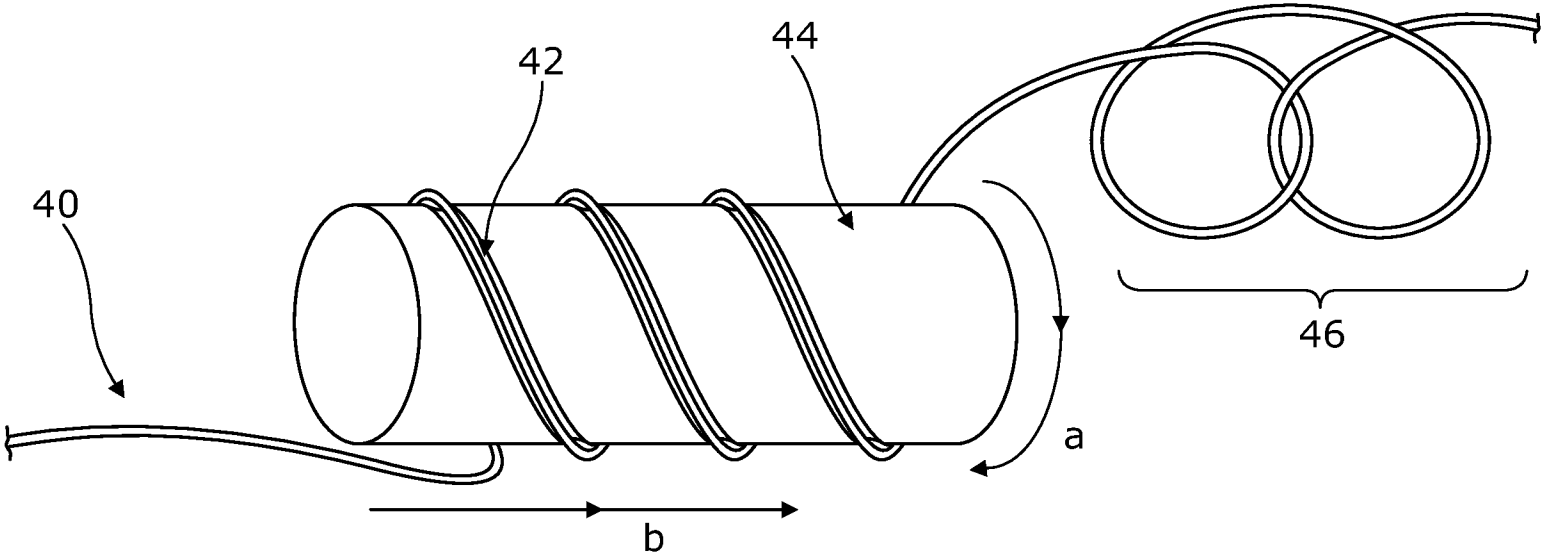
FIG. 7*d* illustrates a method of forming a coiled folded fabric strip comprising multiple structural support components of the invention.

FIG. 7*d* shows the formation of a coiled folded fabric strip 46 having a thermoplastic coating encased between the folded fabric layers, the coiled folded fabric strip 46 comprising two or more structural support components of the invention which are joined to one another on a single fabric strip.

The folded fabric strip 40 having a thermoplastic coating encased between the folded fabric layers is formed by: providing a fabric strip having a length suitable for forming two or more textile elements of the invention; applying a thermoplastic coating extending length wise along a surface of the fabric strip; and folding the fabric strip length wise so as to encase the thermoplastic material. Steps suitable for doing so are described above.

The folded fabric strip 40 is subsequently coiled by feeding the folded fabric strip onto a screw-thread 42 on a cylinder 44. Rotation of the screw thread (indicated by arrow "a") forces the folded fabric strip around and along it (indicated by arrow "b"), and defines a coiled folded fabric strip. The thermoplastic coating cools and rigidifies whilst the folded fabric strip is held in a coiled shape, so that the folded fabric strip retains a coiled shape when removed from the screw-thread.

Figure 8A:
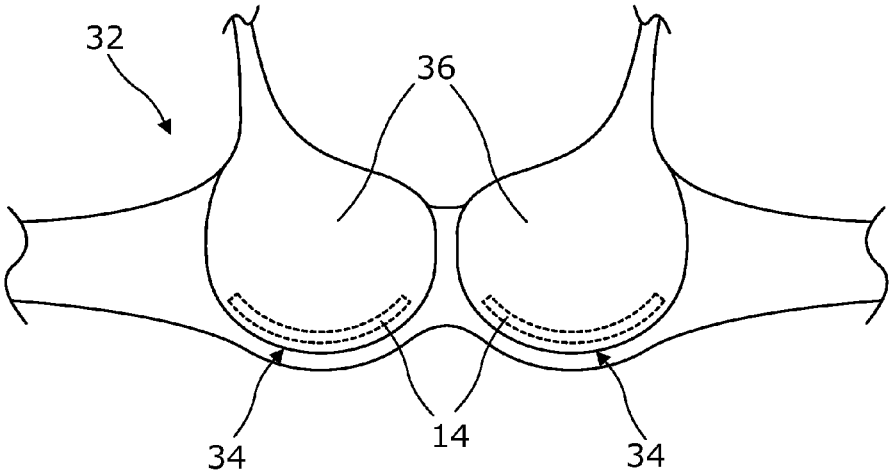
FIGS. 8*a* and 8*b* respectively show structural support components according to sixth and seventh embodiments of the invention.

FIG. 8*a* shows a pair of structural support components according to a sixth embodiment of the invention that forms part of a brassiere 32.

In FIG. 8*a*, each structural support component comprises a textile element 10 in which a thermoplastic coating 14 is applied to a plush surface on a fabric layer of the brassiere 32 so that yarns of the plush surface are embedded in the thermoplastic coating 14 and form a composite structure at the juncture between the thermoplastic coating 14 and the plush surface. The textile element in each case is moulded into a curved cross-sectional shape, e.g. a curved wire or strip. Each structural support component is encased between laminated fabric layers of the brassiere 32, and extends along a bottom edge 34 forming part of a respective support cup 36 of the brassiere 32, so as to be positioned to support a base of a breast held by that support cup 36.

Figure 8B:
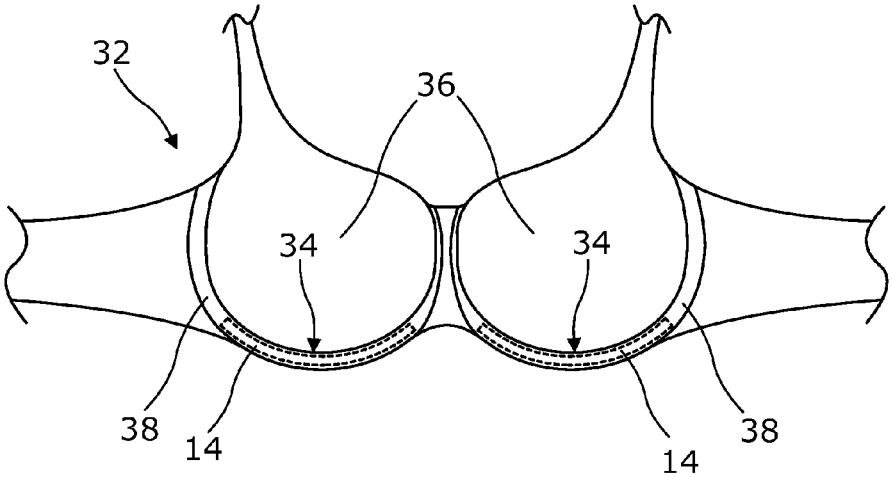

FIG. 8*b* shows a pair of structural support components according to a seventh embodiment of the invention that forms part of a brassiere 32.

In FIG. 8*b*, each structural support component comprises a textile element 10 in which a thermoplastic coating 14 is applied to a plush surface on a fabric layer of the brassiere 32 so that yarns of the plush surface are embedded in the thermoplastic coating 14 and form a composite structure at the juncture between the thermoplastic coating 14 and the plush surface. The textile element in each case is moulded into a curved cross-sectional shape, e.g. a curved wire or strip. Each structural support component is encased between laminated fabric layers of the brassiere 32, and extends along a curved section 38 underneath and adjacent to a bottom edge 34 forming part of a respective support cup 36 of the brassiere 32, so as to be positioned to support a base of a breast held by that support cup 36.

Figure 8C:
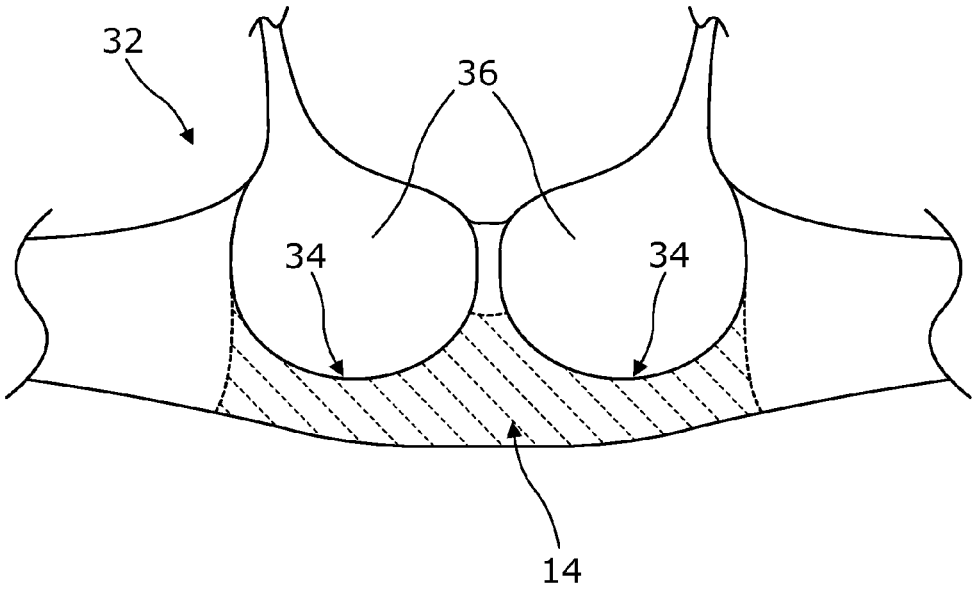
FIG. 8*c* shows a structural support component according to an eighth embodiment of the invention.

FIG. 8*c* shows a structural support component according to an eighth embodiment of the invention that forms part of a brassiere 32.

In FIG. 8*c*, the structural support component comprises a textile element 10 in which a thermoplastic coating 14 is applied to a plush surface of a fabric layer of the brassiere 32 so that yarns of the plush surface are embedded in the thermoplastic coating 14 and form a composite structure at the juncture between the thermoplastic coating 14 and the plush surface. The textile element in each case is moulded into a composite cross-sectional shape that consists of a substantially rectangular shape, from which a pair of substantially semi-circular cut-outs is omitted. The structural support component is encased between laminated fabric layers of the brassiere 32, and extends along a support region underneath support cups 36 of the brassiere 32, so as to be positioned to support a base of each breast held by each support cup 36. The shape of each substantially semi-circular cut-out corresponds to the shape of the bottom edge 34 of the respective support cup 36.

The formation of each structural component shown in FIG. 8*a* will now be described, as follows.

First and second fabric layers are selected such that the two fabric layers are identical in size, and that a part of each fabric layer is formed to have the same shape as a support cup 36.

Powder adhesive is applied to a surface of each fabric layer that defines an inner surface, in order to permit adhesion of the inner surfaces of the first and second fabric layers to each other.

The thermoplastic coating 14 is applied onto a plush surface provided on part of the inner surface of the first fabric layer that corresponds to a bottom edge 34 forming part of the support cup 36. The thermoplastic coating 14 is applied to the plush surface to as to absorb and penetrate into the plush surface and encase yarns of the plush surface. The thermoplastic coating 14 is then allowed to cool so as to allow the thermoplastic coating 14 to rigidify in the required shape and form the structural support component. On cooling of the thermoplastic coating 14, the yarns of the plush surface are embedded in the thermoplastic coating 14 so as to form a composite structure at the juncture between the thermoplastic coating 14 and the plush surface.

Preferably pressure is applied to the moulded thermoplastic coating 14 during cooling. The application of pressure ensures the formation of a flat surface for contact with a wearer's skin when the garment is worn and also further helps to ensure that the moulded thermoplastic coating 14 retains the required shape during cooling.

The second fabric layer is then placed on top of the first fabric layer such that the inner surfaces of the two fabric layers overlap and that the thermoplastic coating 14 is encased between the plush surface of the first fabric layer and the inner surface of the second fabric layers. The two fabric layers are then heated to a lamination temperature that is high enough to melt the powder adhesive, but not high enough to melt the thermoplastic coating 14 so as to allow the thermoplastic coating 14 to retain its moulded shape. Melting the powder adhesive causes adhesion of the inner surfaces of the fabric layers to each other so as to form a pair of laminated fabric layers.

In this manner each structural support component is formed between laminated fabric layers of a brassiere 32, and extends along a bottom edge 34 forming part of a respective support cup 36 of the brassiere 32.

Alternatively the thermoplastic coating 14 may be heated and moulded into its required shape during lamination of the two fabric layers, rather than before the lamination of the two fabric layers. This is achieved by setting the lamination temperature to be high enough to melt the powder adhesive, and also high enough to melt the thermoplastic coating 14 so as to allow the thermoplastic coating 14 to be moulded into its required shape.

The above formation of each structural component shown in FIG. 8*a* applies mutatis mutandis to formation of each structural component shown in FIG. 8*b*, except that the first and second fabric layers are also selected such that another part of each fabric layer is formed to define a curved section 38 underneath and adjacent a bottom edge 34 forming part of a support cup 36 of a brassiere 32, and that the thermoplastic coating 14 is applied onto a part of the inner surface of the first fabric layer that corresponds to the curved section 38.

The above formation of each structural component shown in FIG. 8*a* also applies mutatis mutandis to formation of each structural component shown in FIG. 8*c*, except that the first and second fabric layers are also selected such that another part of each fabric layer is formed to define a support region underneath support cups 36 of a brassiere 32, and that the thermoplastic coating 14 is applied onto a plush surface provided on a part of the inner surface of the first fabric layer that corresponds to the support region.

Figure 9A:
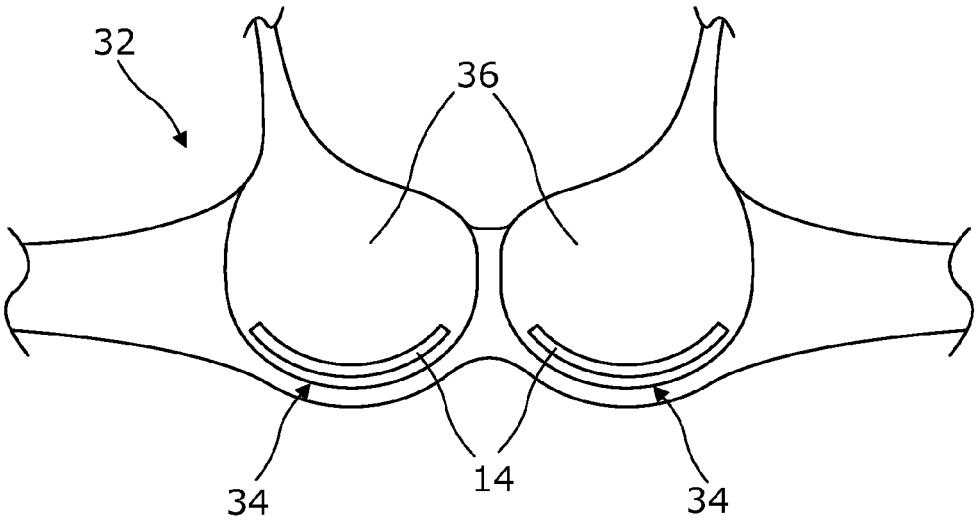
FIGS. 9*a* and 9*b* respectively show structural support components according to ninth and tenth embodiments of the invention.

FIG. 9*a* shows a pair of structural support components according to a ninth embodiment of the invention that forms part of a brassiere 32. Each structural support component in FIG. 9*a* is identical to each structural support component in FIG. 8*a*, except that each structural support component in FIG. 9*a* is formed on an outer surface of a brassiere along a bottom edge 34 forming part of a respective support cup 36 of the brassiere 32, instead of being encased between laminated fabric layers of the brassiere 32.

Figure 9B:
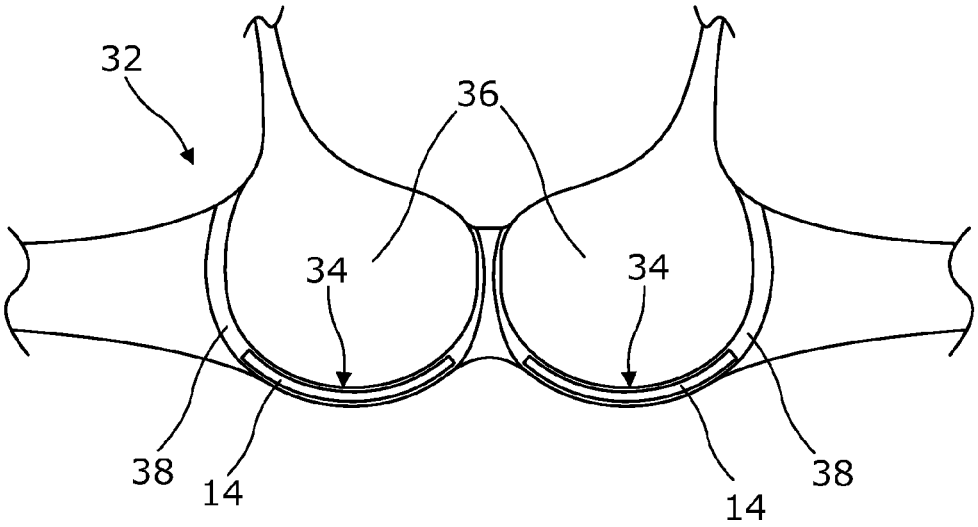

FIG. 9*b* shows a pair of structural support components according to a tenth embodiment of the invention that forms part of a brassiere 32. Each structural support component in FIG. 9*b* is identical to each structural support component in FIG. 8*b*, except that each structural support component in FIG. 9*b* is formed on an outer surface of a brassiere along a curved section 38 underneath and adjacent to a bottom edge 34 forming part of a respective support cup 36 of the brassiere 32, instead of being encased between laminated fabric layers of the brassiere 32.

Figure 9C:
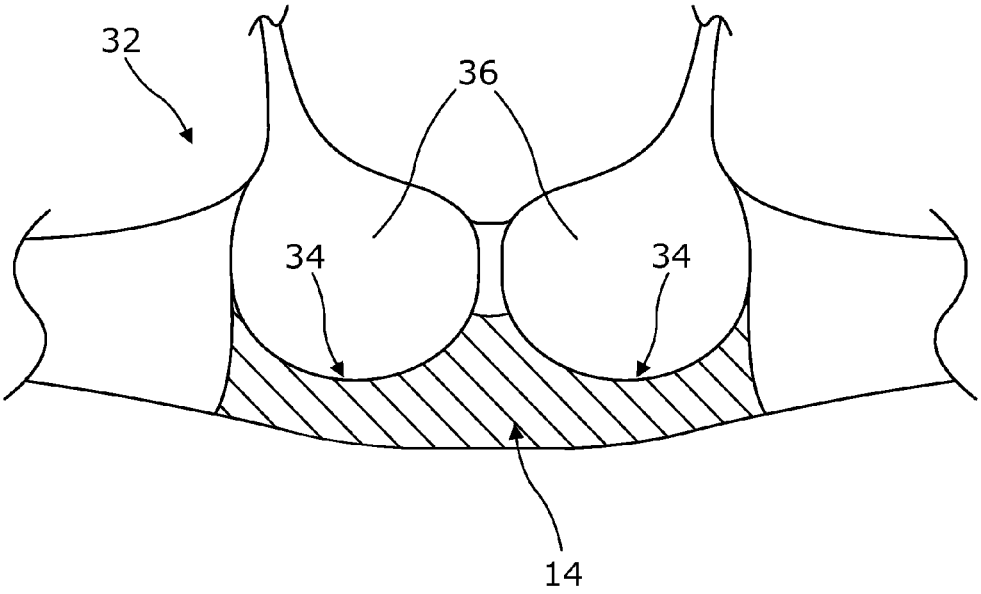
FIG. 9*c* shows a structural support component according to an eleventh embodiment of the invention.

FIG. 9*c* shows a structural support component according to an eleventh embodiment of the invention that forms part of a brassiere 32. The structural support component in FIG. 9*c* is identical to the structural support component in FIG. 8*c*, except that each structural support component in FIG. 9*b* is formed on an outer surface of a brassiere along a support region located underneath support cups 36 of the brassiere 32, instead of being encased between laminated fabric layers of the brassiere 32.

Figure 9D:
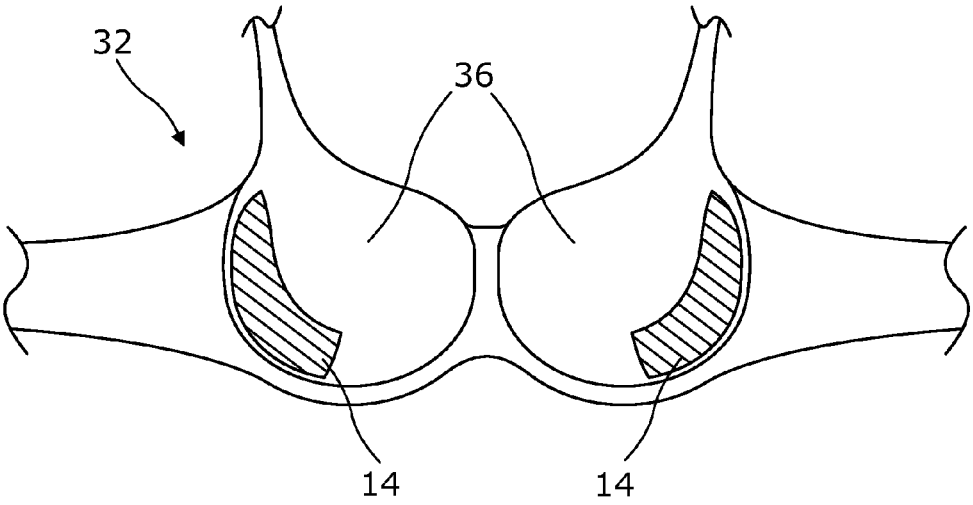
FIG. 9*d* shows a structural support component according to a twelfth embodiment of the invention.

FIG. 9*d* shows a structural support component according to a twelfth embodiment of the invention that forms part of a brassiere 32. The structural support component is formed on the outer surface of a brassiere 32, and extends along the edges of the cups 36 of the brassiere 32, so as to be positioned to support the sides of each breast held by each support cup 36. The structural support component is moulded to form a three-dimensional shape, which provides further comfort and support to the wearer's breasts and improves the aesthetic appearance of the brassiere and the wearer's body.

In each of the ninth, tenth, eleventh and twelfth embodiments respectively shown in FIGS. 9*a*, 9*b*, 9*c* and 9*d*, the or each structural support component is formed on a front surface of the brassiere 32, i.e. the surface of the brassiere 32 that faces away from a body of a user wearing the brassiere 32. In other embodiments, it is envisaged that each structural support component may be formed on a back surface of the respective support cup 36, i.e. the surface of the brassiere 32 that faces a body of a user wearing the brassiere 32.

The formation of each structural component shown in FIG. 9*a* will now be described as follows.

As with the formation of each structural component shown in FIG. 8*a*, first and second fabric layers are selected such that the two fabric layers are identical in size, and that part of each fabric layer is formed to have the same shape as a support cup 36.

Powder adhesive is applied to a surface of each fabric layer that defines an inner surface, in order to permit adhesion of the inner surfaces of the first and second fabric layers to each other.

The thermoplastic coating 14 is applied onto a plush surface provided on a part of the outer surface of the first fabric layer that corresponds to a bottom edge 34 forming part of the support cup 36, whereby the outer and inner surfaces are on opposite sides of the first fabric layer. The thermoplastic coating 14 is applied to the plush surface to as to absorb and penetrate into the plush surface and encase yarns of the plush surface. The thermoplastic coating 14 is then allowed to cool so as to allow the thermoplastic coating 14 to rigidify in the required shape and form the structural support component. On cooling of the thermoplastic coating 14, the yarns of the plush surface are embedded in the thermoplastic coating 14 so as to form a composite structure at the juncture between the thermoplastic coating 14 and the plush surface.

Again, as with the formation of each structural component shown in FIG. 8*a*, pressure is preferably applied to the moulded thermoplastic coating 14 during cooling. The application of pressure ensures the formation of a flat surface for contact with a wearer's skin when the garment is worn and also further helps to ensure that the moulded thermoplastic coating 14 retains the required shape during cooling.

The second fabric layer is then placed on top of the first fabric layer such that the inner surfaces of the two fabric layers overlap. The two fabric layers are then heated to a lamination temperature that is high enough to melt the powder adhesive, but not high enough to melt the thermoplastic coating 14 so as to allow the thermoplastic coating 14 to retain its moulded shape. Melting the powder adhesive causes adhesion of the inner surfaces of the fabric layers to each other so as to form a pair of laminated fabric layers.

In this manner each structural support component is formed on an outer surface of a support cup 36 of the brassiere 32, and extends along a bottom edge 34 forming part of a respective support cup 36 of the brassiere 32.

Alternatively the thermoplastic coating 14 may be heated and moulded into its required shape during lamination of the two fabric layers, rather than before the lamination of the two fabric layers. This is achieved by setting the lamination temperature is high enough to melt the powder adhesive, and also high enough to melt the thermoplastic coating 14 so as to allow the thermoplastic coating 14 to be moulded into its required shape.

The above formation of each structural component shown in FIG. 9*a* applies mutatis mutandis to formation of each structural component shown in FIG. 9*b*, except that the first and second fabric layers are also selected such that another part of each fabric layer is formed to define a curved section 38 underneath and adjacent a bottom edge 34 forming part of a support cup 36 of a brassiere 32, and that the thermoplastic coating 14 is applied onto a part of the outer surface of the first fabric layer that corresponds to the curved section 38.

The above formation of each structural component shown in FIG. 9*a* also applies mutatis mutandis to formation of each structural component shown in FIG. 9*c*, except that the first and second fabric layers are also selected such that another part of each fabric layer is formed to define a support region underneath support cups 36 of a brassiere 32, and that the thermoplastic coating 14 is applied onto a part of the outer surface of the first fabric layer that corresponds to the support region.

In each of the ninth, tenth, eleventh and twelfth embodiments respectively shown in FIGS. 9*a*, 9*b*, 9*c* and 9*d*, a surface of the thermoplastic coating 14 may be flocked, and/or each structural support component may further include a covering fabric to cover the thermoplastic coating 14. Such an arrangement allows the thermoplastic coating 14 to be in face to face contact with a wearer's skin when the brassiere 32 is worn.

It is further envisaged that, in other embodiments of the invention, some or all of the structural support components shown in FIGS. 8*a*, 8*b*, 8*c*, 9*a*, 9*b*, 9*c* and 9*d* may be used in combination in the same brassiere 32.

It will be appreciated that the above method is applicable to other garments that employ the use of a plurality of laminated fabric layers. Furthermore, each structural component may be formed on a plush surface provided on an outer surface of a single fabric layer, instead of on a plush surface provided on an outer surface of a fabric layer forming part of a plurality of laminated fabric layers.

In FIGS. 8*a*, 8*b*, 8*c*, 9*a*, 9*b*, 9*c* and 9*d*, the moulded thermoplastic coating 14 is shown moulded into the shape typically associated with the support components required for use in brassieres 32. It is envisaged however that the thermoplastic coating 14 could be used to form a structural support component for use in other garments requiring structural support components. The thermoplastic coating 14 could for example be used to create a structural support component for use in a dress or bustier or corset in the form of a stiffening member to maintain the shape and structure of the garment.

In each of the sixth, seventh, eighth, ninth, tenth, eleventh and twelfth embodiments shown in FIGS. 8*a*, 8*b*, 8*c*, 9*a*, 9*b*, 9*c* and 9*d*, the thermoplastic coating 14 has a thickness D of 1.5 mm. In other embodiments, the thermoplastic coating 14 may have a thickness of approximately 1.5 mm. In other embodiments, the thickness of the thermoplastic coating 14 may be varied, depending on the strength and rigidity required by the thermoplastic coating 14, within the range of 0.1 mm-1.8 mm or approximately 0.1 mm to approximately 1.8 mm, and preferably in the range of 0.5 mm-1.8 mm or approximately 0.5 mm to approximately 1.8 mm.

The thermoplastic coating 14 in each of the sixth, seventh, eighth, ninth, tenth, eleventh and twelfth embodiments is preferably a polyamide coating having a melting temperature in excess of 100° C. or approximately 100° C., and more preferably in excess of 150° C. or approximately 150° C. In other words, the melting temperature of the thermoplastic coating 14 is preferably greater than 100° C. or approximately 100° C., and even more preferably greater than 150° C. or approximately 150° C. The higher the melting temperature of the thermoplastic coating 14, the less likely the thermoplastic coating 14 is to melt during machine washing of a garment incorporating the thermoplastic coating 14 as a structural support component.

In other embodiments the thermoplastic coating 14 may be a polyester coating having a similar melting temperature.

Figure 10A:
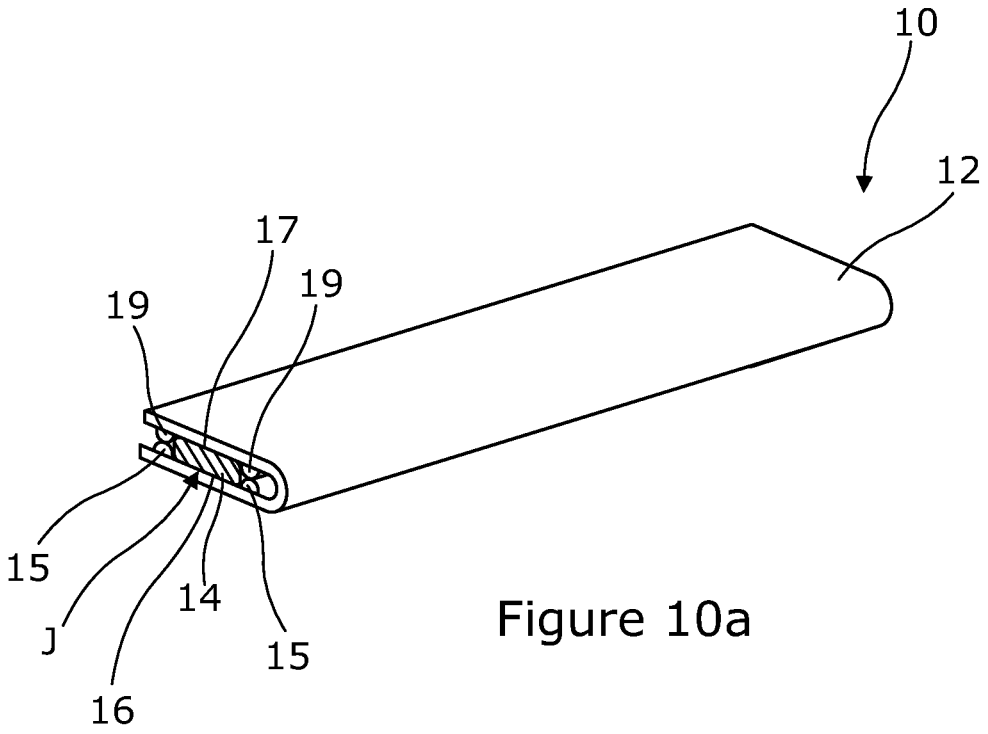
FIGS. 10*a* and 10*b* show a textile element according to a thirteenth embodiment of the invention.
Figure 10B:
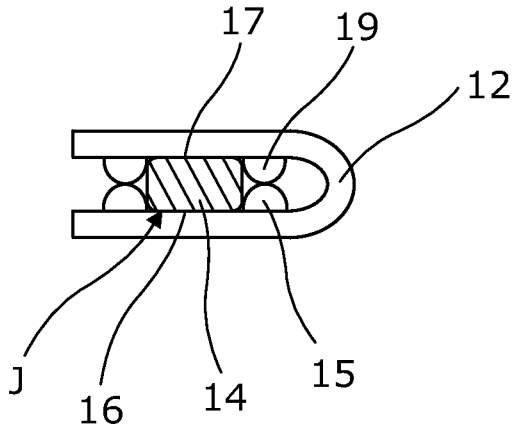

A textile element 10 according to a thirteenth embodiment of the invention is shown in FIGS. 10*a* and 10*b*.

The textile element 10 includes a fabric strip 12 having a plush surface 14 and a thermoplastic coating extending applied to the plush surface 16 of the fabric strip 12 so that yarns of the plush surface 16 are embedded in the thermoplastic coating 14 and form a composite structure at the juncture between the thermoplastic coating 14 and the plush surface 16.

The textile element 10 also includes a pair of ribs 15 protruding from the fabric strip 12 and extending along opposite sides of the plush surface 16, on opposite sides of the thermoplastic coating 14.

The fabric strip 12 is folded so as to sandwich the thermoplastic coating 14 between the plush surface 16 and an opposing surface 17 of the fabric strip 12. The textile element 10 further includes a pair of ribs 19 protruding from the opposing surface 17 and aligned in face to face contact with the ribs 15 protruding from the fabric strip on opposite sides of the plush surface 16.

The formation of the textile element 10 shown in FIG. 10 will now be described, as follows.

A fabric strip 12 have a plush surface 16 is selected and arranged so as to expose the plush surface 16.

So as to create the plush surface 16, which has a long, soft nap or raised pile, the fabric strip 12 is a woven structure in which the plush surface 16 is created by the use of textured yarns (not shown) in the woven structure at the plush surface 16.

In other embodiments the fabric strip 12 may have a woven structure in which the plush surface 16 is created by reducing the number and/or thickness of weft yarns when compared to the number and/or thickness of warp yarns in the woven structure at the plush surface 16. This arrangement increases the exposure of the warp yarns in the woven structure at the plush surface 16 and thus produces the required nap or pile.

In yet further embodiments the fabric strip 12 may have a woven structure in which the plush surface 16 is created by arranging warp yarns to form floating warp yarns passing over two or more weft yarns at a time so as to increase exposure of the warp yarns in the woven structure at the plush surface 16.

In yet further embodiments the fabric strip 12 may have a knitted structure.

The thermoplastic coating 14 is applied to the plush surface 16 by extruding molten thermoplastic material along the plush surface 16 of the fabric strip 12, between the ribs 15 protruding from the fabric strip 12 on opposite sides of the plush surface 16.

The provision of a plush surface 16 on the fabric strip 12 means that, during application of the thermoplastic coating 14, the molten thermoplastic material absorbs and penetrates into the plush surface 16 and coats the yarns of the plush surface 16. The viscosity of the molten thermoplastic material is chosen so as to maximise the absorption and penetration of the molten thermoplastic material into the plush surface 16.

The use of a fabric strip 12 having a plush surface 16 helps to prevent leakage of molten thermoplastic material during application of the thermoplastic coating 14 because it allows the molten thermoplastic material to penetrate therein and thereby restrains flow of the molten thermoplastic material. Flow of the molten thermoplastic material is further restrained by the provision of ribs 15 protruding from the fabric strip 12 on opposite sides of the plush surface 16.

The fabric strip 12 is then folded about the molten thermoplastic material so as to sandwich the molten thermoplastic material between the plush surface and an opposing surface 17 of the fabric strip 12. The ribs 19 protruding from the opposing surface 17 of the fabric strip 12 are aligned in face to face contact with the ribs 15 protruding from the fabric strip 12 on opposite sides of the plush surface 16 so as to form an envelope in which the molten thermoplastic material is retained.

Preferably, the fabric strip 12 is not folded until the thermoplastic coating 14 has cooled so as to exhibit a soft and tacky surface that will adhere to the opposing surface 17 of the fabric strip 12.

The thermoplastic coating 14 is then allowed to cool and rigidify, thereby embedding the yarns of the plush surface 16 in the thermoplastic coating 14 and forming a composite structure at the juncture J between the thermoplastic coating and the plush surface 16.

Penetration of the thermoplastic coating 14 into the plush surface 16 and the formation of a composite structure in which the yarns are embedded in the thermoplastic coating 14 increases the strength and flexibility of the textile element 10 over and above a textile element formed from a thermoplastic material applied to a non-plush surface of a textile carrier, as outlined above.

The textile element 10 produces a substantially elastic response when subjected to a force tending to cause flexure or bending. This is to say, the textile element 10 will flex or bend upon application of a force tending to cause flexure or bending and will return automatically to its original shape once the force causing flexure or bending is removed.

In other, similar embodiments, it is envisaged that the ribs 19 protruding from the opposing surface 17 of the fabric strip 12 may be omitted.

In further, similar embodiments, it is envisaged that the fabric strip 12 may include a plush surface provided on the opposing surface 17 of the fabric strip 12, between the ribs 19 protruding from the opposing surface 17, and thermoplastic material may be applied to the plush surface on the opposing surface 17 at the same time as thermoplastic material is applied to the plush surface located between ribs 15.

In such embodiments, once the thermoplastic material is allowed to cool so as to form a soft and tacky surface, the fabric strip 12 may be folded so as to align the ribs 15 protruding either side of the plush surface 16 and the ribs 19 protruding from the opposing surface 17 so as to encase the thermoplastic coating provided on both plush surfaces between the ribs 15,19.

This allows the creation of a thicker layer of thermoplastic coating than would otherwise be possible through the application of thermoplastic material to a single plush surface 16 and also increases the depth of the resultant composite structure by ensuring that the thermoplastic material penetrates into both of the plush surfaces—thereby ensuring that the strength of the resultant textile element is comparable to the depth of the thermoplastic coating.

The invention claimed is:

1. A method of forming a textile element for use as a structural support component in a garment, the method comprising the steps of:

(i) providing a fabric strip having a plush surface portion and another adjacent surface portion;

(ii) applying a molten thermoplastic coating to the plush surface portion of the fabric strip so that the thermoplastic coating penetrates the plush surface portion; and (iii) allowing the thermoplastic coating to cool and solidify so as to embed at least surface yarns of the plush surface portion in the thermoplastic coating and thereby form a composite structure at a juncture between the thermoplastic coating and the plush surface portion, wherein the fabric strip is a woven fabric including a pair of ribs protruding from the fabric strip, on opposite sides of the plush surface portion so as to flank the plush surface portion, the thermoplastic coating being applied to the plush surface portion, between the ribs, so that the thermoplastic coating penetrates the plush surface portion so as to embed the yarns of the plush surface portion in the composite structure following cooling and solidifying of the thermoplastic coating, and the method further includes the step of folding the fabric strip about the thermoplastic coating before allowing the thermoplastic coating to cool and solidify so as to sandwich the thermoplastic coating between the plush surface portion and another adjacent surface portion of the fabric strip so that the plush surface and the another adjacent surface portion of the fabric strip are folded over each other to be in opposition with each other, and wherein the fabric strip further includes a pair of ribs protruding from the another adjacent surface portion of the fabric strip and the step of folding the fabric strip about the thermoplastic coating involves aligning the ribs protruding from the another adjacent surface portion in face to face contact with the ribs protruding from the fabric strip on opposite sides of the plush surface portion.

2. The method of claim 1, wherein the fabric strip includes a backing to the plush surface portion, the backing being more densely woven than the rest of the fabric strip so as to prevent penetration of the thermoplastic coating through the entire depth of the fabric strip.

3. The method of claim 1, wherein the thermoplastic coating penetrates the plush surface portion so as to produce a substantially elastic textile element when flexed once the thermoplastic coating is allowed to cool and solidify.

4. The method of claim 1 wherein the fabric strip has a further plush surface portion located between the ribs protruding from the another adjacent surface portion, and the step of applying the molten thermoplastic coating includes applying the molten thermoplastic coating to the further plush surface portion between the ribs protruding from the another adjacent surface portion so that the thermoplastic coating penetrates the plush surface portion.

5. The method of claim 1, wherein the fabric strip and the plush surface portion have a length suitable for forming two or more textile elements and the thermoplastic coating is applied length wise along the plush surface portion so as to include breaks in the thermoplastic coating at predetermined intervals along the length of the plush surface portion.

6. The method of claim 5, further including the step of coiling the fabric strip before the thermoplastic coating solidifies so as to set the fabric strip in a helical coil structure having a predetermined diameter, wherein the step of coiling the fabric strip takes place after the step of folding the fabric strip about the thermoplastic coating.

7. The method of claim 6, further including the step of cutting the fabric strip, once the thermoplastic coating has cooled and solidified, at the breaks in the thermoplastic coating so as to form individual elements having no thermoplastic coating at each end.

8. The method of claim 1, wherein the thermoplastic coating is a polyamide.

9. The method of claim 1, wherein the thermoplastic coating is a polyester.

10. A textile element for use as a structural support component in a garment, the textile element comprising:

a fabric strip having a plush surface portion and another adjacent surface portion, and the fabric strip having a thermoplastic coating applied to the plush surface portion so that at least surface yarns of the plush surface portion are embedded in the thermoplastic coating and form a composite structure at the juncture between the thermoplastic coating and the plush surface portion, wherein the fabric strip is a woven fabric including a pair of ribs protruding from the fabric strip on opposite sides of the plush surface portion so as to flank the plush surface portion, the thermoplastic coating being applied to the plush surface portion, between the ribs, so that the yarns of the plush surface portion are embedded in the thermoplastic coating in the composite structure, and the fabric strip is folded about the thermoplastic coating so as to sandwich the thermoplastic coating between the plush surface portion and another adjacent surface portion of the fabric strip so that the plush surface portion and the another adjacent surface portion of the fabric strip are folded over each other to be in opposition with each other, and wherein the fabric strip further includes a pair of ribs protruding from the another adjacent surface portion of the fabric strip, the fabric strip being folded so as to align the ribs protruding from the another adjacent surface portion in face to face contact with the ribs protruding from the fabric strip on opposite sides of the plush surface portion.

11. The textile element according to claim 10 wherein the fabric strip includes a backing to the plush surface portion, the backing being more densely woven than the rest of the fabric strip.

12. The textile element according to claim 10 wherein the textile element exhibits a substantially elastic response when flexed.

13. A method of forming a textile element for use as a structural support component in a garment, the method comprising the steps of:

(i) providing a fabric strip having a plush surface portion and another adjacent surface portion;

(ii) applying a molten thermoset coating to the plush surface portion of the fabric strip so that the thermoset coating penetrates the plush surface portion; and (iii) curing the thermoset coating so as to embed at least surface yarns of the plush surface portion in the thermoset coating and thereby form a composite structure at a juncture between the thermoset coating and the plush surface portion, wherein the fabric strip is a woven fabric including a pair of ribs protruding from the fabric strip, on opposite sides of the plush surface portion so as to flank the plush surface portion, the thermoset coating being applied to the plush surface portion, between the ribs, so that the thermoset coating penetrates the plush surface portion so as to embed the yarns of the plush surface portion in the composite structure following curing of the thermoset coating, and the method further includes the step of folding the fabric strip about the thermoset coating before allowing the thermoset coating to cure so as to sandwich the thermoset coating between the plush surface portion and another adjacent surface portion of the fabric strip so that the plush surface portion and the another adjacent surface portion of the fabric strip are folded over each other to be in opposition with each other, and wherein the fabric strip further includes a pair of ribs protruding from the another adjacent surface portion of the fabric strip and the step of folding the fabric strip about the thermoset coating involves aligning the ribs protruding from the another adjacent surface portion in face to face contact with the ribs protruding from the fabric strip on opposite sides of the plush surface portion.

14. A textile element for use as a structural support component in a garment, the textile element comprising:

a fabric strip having a plush surface portion and another adjacent surface portion, and the fabric strip having a thermoset coating applied to the plush surface portion so that at least surface yarns of the plush surface portion are embedded in the thermoset coating and form a composite structure at a juncture between the thermoset coating and the plush surface portion, wherein the fabric strip is a woven fabric including a pair of ribs protruding from the fabric strip on opposite sides of the plush surface so as to flank the plush surface portion, the thermoset coating being applied to the plush surface portion, between the ribs, so that the yarns of the plush surface portion are embedded in the thermoset coating in the composite structure, and the fabric strip is folded about the thermoset coating so as to sandwich the thermoset coating between the plush surface portion and another adjacent surface portion of the fabric strip so that the plush surface portion and the another adjacent surface portion of the fabric strip are folded over each other to be in opposition with each other, and wherein the fabric strip further includes a pair of ribs protruding from the another adjacent surface portion of the fabric strip, the fabric strip being folded so as to align the ribs protruding from the another adjacent surface portion in face to face contact with the ribs protruding from the fabric strip on opposite sides of the plush surface portion.

* * * * *